US005538595A

United States Patent [19]

Trokhan et al.

[11] Patent Number: 5,538,595

[45] Date of Patent: Jul. 23, 1996

[54] CHEMICALLY SOFTENED TISSUE PAPER PRODUCTS CONTAINING A PLOYSILOXANE AND AN ESTER-FUNCTIONAL AMMONIUM COMPOUND

[75] Inventors: Paul D. Trokhan, Hamilton; Dean V. Phan; Ward W. Ostendorf, both of West Chester; Joel K. Monteith, Bethel; Bart S. Hersko, Cincinnati; Robert S. Ampulski, Fairfield, all of Ohio

[73] Assignee: The Proctor & Gamble Company, Cincinnati, Ohio

[21] Appl. No.: 443,145

[22] Filed: May 17, 1995

[51] Int. Cl.[6] ..... D21H 21/22

[52] U.S. Cl. ..... 162/123; 162/111; 162/112; 162/127; 162/129; 162/130; 162/158; 162/164.1; 162/164.3; 162/164.4; 162/168.1; 162/168.3; 162/175; 162/177; 162/179

[58] Field of Search ..... 162/111, 112, 162/113, 109, 135, 123, 127, 129, 130, 158, 164.1, 164.3, 164.4, 168.1, 168.3, 175, 177, 179

[56] References Cited

U.S. PATENT DOCUMENTS

| | | | |
|---|---|---|---|
| 2,683,087 | 7/1954 | Reynolds, Jr. | 162/158 |
| 2,683,088 | 7/1954 | Reynolds, Jr. | 162/158 |
| 3,301,746 | 1/1967 | Sanford et al. | 162/113 |
| 3,554,863 | 1/1971 | Hervey et al. | 162/158 |
| 3,755,220 | 8/1973 | Freimark et al. | 260/17.3 |
| 3,844,880 | 10/1974 | Meisel, Jr. et. al. | 162/169 |
| 3,974,025 | 8/1976 | Ayers | 162/113 |
| 3,994,771 | 11/1976 | Morgan, Jr. et. al. | 162/113 |
| 4,144,122 | 3/1979 | Emanuelsson et al. | 162/158 |
| 4,191,609 | 3/1980 | Trokhan | 162/113 |
| 4,300,981 | 11/1981 | Carstens | 162/109 |
| 4,351,699 | 9/1982 | Osborn, III | 162/112 |
| 4,377,543 | 3/1983 | Stohbeen et al. | 264/120 |
| 4,441,962 | 4/1984 | Osborn, III | 162/111 |
| 4,447,294 | 5/1984 | Osborn, III | 162/158 |
| 4,529,480 | 7/1985 | Trokhan | 162/109 |
| 4,637,859 | 1/1987 | Trokhan | 162/109 |
| 4,795,530 | 1/1989 | Soerens et al. | 162/111 |
| 4,940,513 | 7/1990 | Spendel | 162/112 |
| 4,950,545 | 8/1990 | Walter et al. | 428/446 |
| 4,959,125 | 9/1990 | Spendel | 162/158 |
| 5,059,282 | 10/1991 | Ampulski et al. | 162/111 |
| 5,164,046 | 11/1992 | Ampulski et al. | 162/112 |
| 5,215,626 | 6/1993 | Ampulski et al. | 162/112 |
| 5,217,576 | 6/1993 | Phan | 162/111 |
| 5,223,096 | 6/1993 | Phan et al. | 162/111 |
| 5,227,242 | 7/1993 | Walter et al. | 428/446 |
| 5,240,562 | 8/1993 | Phan et al. | 162/158 |
| 5,246,545 | 9/1993 | Ampulski et al. | 162/112 |
| 5,246,546 | 9/1993 | Ampulski | 162/112 |
| 5,262,007 | 11/1993 | Phan et al. | 162/112 |
| 5,264,082 | 11/1993 | Phan et al. | 162/111 |
| 5,279,767 | 1/1994 | Phan et al. | 252/357 |
| 5,312,522 | 5/1994 | Phan et al. | 162/111 |
| 5,405,501 | 4/1995 | Phan et al. | 162/112 |
| 5,437,766 | 8/1995 | Phan et al. | 162/112 |

FOREIGN PATENT DOCUMENTS

| | | |
|---|---|---|
| 61-308312 | 7/1988 | Japan . |
| 4-100995 | 4/1992 | Japan . |

OTHER PUBLICATIONS

"Applications of Armak Quaternary Ammonium Salts", Bulletin 76–17, Armak Co., (1977).

*Primary Examiner*—Peter Chin

*Attorney, Agent, or Firm*—Bart S. Hersko; E. Kelly Linman; Jacobus C. Rasser

[57] ABSTRACT

Tissue paper products comprising a two component chemical softener composition and binder materials, either permanent or temporary wet strength binders, and/or dry strength binders are disclosed. The two component chemical softening composition comprises an ester-functional ammonium compound and a polysiloxane compound. Preferred ester-functional ammonium compounds include diester dialkyl dimethyl ammonium salts such as diester di(touch hardened)tallow dimethyl ammonium chloride and/or di(hydrogenated)tallow dimethyl ammonium chloride. Preferred polysiloxanes include amino-functional polydimethyl polysiloxanes wherein less than about 10 mole percent of the side chains on the polymer contain an amino-functional group.

37 Claims, 2 Drawing Sheets

CHEMICALLY SOFTENED TISSUE PAPER PRODUCTS CONTAINING A PLOYSILOXANE AND AN ESTER-FUNCTIONAL AMMONIUM COMPOUND

FIELD OF THE INVENTION

This invention relates to tissue paper products. More particularly, it relates to tissue paper products comprising a two-component chemical softener composition, an ester-fuctional ammonium compound and a polysiloxane compound. Binder materials, either permanent or temporary wet strength binders, and/or dry strength binders can also be used. The treated tissue paper can be used to make soft, absorbent and lint resistant paper products such as facial tissue paper products or toilet tissue paper products.

BACKGROUND OF THE INVENTION

Paper webs or sheets, sometimes called tissue or paper tissue webs or sheets, find extensive use in modern society. Such items as facial and toilet tissues are staple items of commerce. It has long been recognized that four important physical attributes of these products are their strength, their softness, their absorbency, including their absorbency for aqueous systems; and their lint resistance, including their lint resistance when wet. Research and development efforts have been directed to the improvement of each of these attributes without seriously affecting the others as well as to the improvement of two or three attributes simultaneously.

Strength is the ability of the product, and its constituent webs, to maintain physical integrity and to resist tearing, bursting, and shredding under use conditions, particularly when wet.

Softness is the tactile sensation perceived by the consumer as he/she holds a particular product, rubs it across his/her skin, or crumples it within his/her hand. This tactile sensation is provided by a combination of several physical properties. Important physical properties related to softness are generally considered by those skilled in the art to be the stiffness, the surface smoothness and lubricity of the paper web from which the product is made. Stiffness, in turn, is usually considered to be directly dependent on the dry tensile strength of the web and the stiffness of the fibers which make up the web.

Absorbency is the measure of the ability of a product, and its constituent webs, to absorb quantities of liquid, particularly aqueous solutions or dispersions. Overall absorbency as perceived by the consumer is generally considered to be a combination of the total quantity of liquid a given mass of tissue paper will absorb at saturation as well as the rate at which the mass absorbs the liquid.

Lint resistance is the ability of the fibrous product, and its constituent webs, to bind together under use conditions, including when wet. In other words, the higher the lint resistance is, the lower the propensity of the web to lint will be.

The use of wet strength resins to enhance the strength of a paper web is widely known. For example, Westfelt described a number of such materials and discussed their chemistry in Cellulose Chemistry and Technology, Volume 13, at pages 813–825 (1979). Freimark et al. in U.S. Pat. No. 3,755,220 issued Aug. 28, 1973 mention that certain chemical additives known as debonding agents interfere with the natural fiber-to-fiber bonding that occurs during sheet formation in paper making processes. This reduction in bonding leads to a softer, or less harsh, sheet of paper. Freimark et al. go on to teach the use of wet strength resins in conjunction with the use of debonding agents to off-set the undesirable effects of the debonding agents. These debonding agents do reduce both dry tensile strength and wet tensile strength.

Shaw, in U.S. Pat. No. 3,821,068, issued Jun. 28, 1974, also teaches that chemical debonders can be used to reduce the stiffness, and thus enhance the softness, of a tissue paper web.

Chemical debonding agents have been disclosed in various references such as U.S. Pat. No. 3,554,862, issued to Hervey et al. on Jan. 12, 1971. These materials include ester-functional quaternary ammonium compound salts such as cocotrimethylammonium chloride, oleyltrimethylammonium chloride, di(hydrogenated)tallow dimethyl ammonium chloride and stearyltrimethyl ammonium chloride.

Emanuelsson et al., in U.S. Pat. No. 4,144,122, issued Mar. 13, 1979, and Hellsten et al., in U.S. Pat. No. 4,476,323, issued Oct. 9, 1984, teach the use of complex ester-functional quaternary ammonium compounds such as bis-(alkoxy(2-hydroxy)propylene) ester-functional quaternary ammonium compound chlorides to soften webs. These authors also attempt to overcome any decrease in absorbency caused by the debonders through the use of nonionic surfactants such as ethylene oxide and propylene oxide adducts of fatty alcohols.

Armak Company, of Chicago, Ill., in their bulletin 76–17 (1977) disclose the use of dimethyl di(hydrogenated)tallow ammonium chloride in combination with fatty acid esters of Polyethylene Glycols to impart both softness and absorbency to tissue paper webs.

One exemplary result of research directed toward improved paper webs is described in U.S. Pat. No. 3,301,746, issued to Sanford and Sisson on Jan. 31, 1967. Despite the high quality of paper webs made by the process described in this patent, and despite the commercial success of products formed from these webs, research efforts directed to finding improved products have continued.

For example, Becker et al. in U.S. Pat. No. 4,158,594, issued Jan. 19, 1979, describe a method they contend will form a strong, soft, fibrous sheet. More specifically, they teach that the strength of a tissue paper web (which may have been softened by the addition of chemical debonding agents) can be enhanced by adhering, during processing, one surface of the web to a creping surface in a fine patterned arrangement by a bonding material (such as an acrylic latex rubber emulsion, a water soluble resin, or an elastomeric bonding material) which has been adhered to one surface of the web and to the creping surface in the fine patterned arrangement, and creping the web from the creping surface to form a sheet material.

The two component chemical softening compositions of the present invention comprise an ester-functional quaternary ammonium compound and a polysiloxane compound. Unexpectedly, it has been found that the two component chemical softening composition improves the softness of the treated tissue paper compared to the softness benefits obtained from the use of either component individually. In addition, the lint/softness relationship of the treated tissue is also greatly improved.

Unfortunately the use of chemical softening compositions comprising a ester-functional quaternary ammonium compound and a polysiloxane compound can decrease the strength and the lint resistance of the treated paper webs. Applicants have discovered that both strength and lint resistance can be improved through the use of suitable binder materials such as wet and dry strength resins and retention aid resins known in the paper making art.

The present invention is applicable to tissue paper in general, but particularily applicable to multi-ply, multi-layered tissue paper products such as those described in U.S. Pat. No. 3,994,771, issued to Morgan Jr. et al. on Nov. 30, 1976, and in U.S. Pat. No. 4,300,981, Carstens, issued Nov. 17, 1981, both of which are incorporated herein by reference.

The tissue paper products of the present invention contain an effective amount of binder materials, either permanent or temporary wet strength binders, and/or dry strength binders to control linting and/or to offset the loss in tensile strength, if any, resulting from the use of the two component chemical softening compositions.

It is an object of this invention to provide soft, absorbent and lint resistant tissue paper products.

It is also a further object of this invention to provide a process for making soft, absorbent, lint resistant tissue paper products.

These and other objects are obtained using the present invention, as will become readily apparent from a reading of the following disclosure.

SUMMARY OF THE INVENTION

The present invention provides soft, absorbent, lint resistant tissue paper products comprising:

a) paper making fibers;

b) from about 0.01% to about 3.0% of an ester-functional quaternary ammonium compound;

c) from about 0.01% to about 3.0% of a polysiloxane compound; and d) from about 0.01% to about 3.0% of binder materials, either wet strength binders and/or dry strength binders.

Examples of preferred ester-functional quaternary ammonium compounds suitable for use in the present invention include compounds having the formulas:

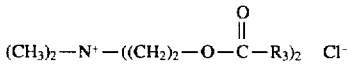

and

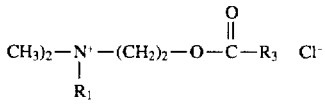

and

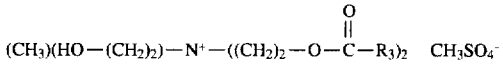

and

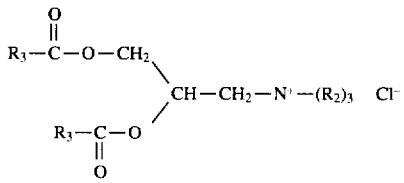

wherein each $R_1$ substituent is a $C_{12}$–$C_{22}$ hydrocarbyl group, or substituted hydrocarbyl group or mixtures thereof; each $R_2$ substituent is a $C_1$–$C_6$ alkyl or hydroxyalkyl group, benzyl group or mixtures thereof; each $R_3$ substituent is a $C_{11}$–$C_{21}$ hydrocarbyl group, or substituted hydrocarbyl or mixtures thereof.

These compounds can be considered to be mono or di-ester variations of the well-known dialkyldimethylammonium salts such as di-ester di(tallow) dimethyl ammonium chloride, di-ester di(stearyl) dimethyl ammonium chloride, mono-ester di(tallow) dimethyl ammonium chloride, di-ester di(hydrogenated)tallow dimethyl ammonium methylsulfate, di-ester di(hydrogenated)tallow dimethyl ammonium chloride, mono-ester di(hydrogenated)tallow dimethyl ammonium chloride, and mixtures thereof, with the di-ester variations of di(non hydrogenated)tallow dimethyl ammonium chloride, Di(Touch Hydrogenated)Tallow DiMethyl Ammonium Chloride (DEDTHTDMAC) and Di(Hydrogenated)Tallow DiMethyl Ammonium Chloride (DEDHTDMAC), and mixtures thereof being preferred. Depending upon the product characteristic requirements, the saturation level of the ditallow can be tailored from non hydrogenated (soft) to touch, partially or completely hydrogenated (hard).

Without being bound by theory, it is believed that the ester moiety(ies) lends biodegradability to these compounds. Importantly, the ester-functional quaternary ammonium compounds used herein biodegrade more rapidly than do conventional dialkyl dimethyl ammonium chemical softeners.

Examples of polysiloxane materials for use in the present invention include an amino-functional polydimethylpolysiloxane wherein less than about 10 mole percent of the side chains on the polymer contain an amino-functional group. Because molecular weights of polysiloxanes can be difficult to ascertain, the viscosity of a polysiloxane is used herein as an objectively ascertainable indicia of molecular weight. Accordingly, for example, about 2 mole percent substitution has been found to be very effective for polysiloxanes having a viscosity of about one-hundred-twenty-five (125) centistokes; and viscosities of about five-million (5,000,000) centistokes or more are effective with or without substitution. In addition to such substitution with amino-functional groups, effective substitution may be made with carboxyl, hydroxyl, ether, polyether, aldehyde, ketone, amide, ester, and thiol groups. Of these effective substituent groups, the family of groups comprising amino, carboxyl, and hydroxyl groups are more preferred than the others; and amino-functional groups are most preferred.

Exemplary commercially available polysiloxanes include DOW 8075 and DOW 200 which are available from Dow Corning; and Silwet 720 and Ucarsil EPS which are available from Union Carbide.

The term binder refers to the various wet and dry strength additives, and retention aids known in the art. These materials produce the functional strength required by the product, improve the lint resistance of the tissue paper webs of the present invention as well as counteracting any decrease in tensile strength caused by chemical softening compositions. Examples of suitable binder materials include: permanent wet strength binders (i.e. Kymene ® 557H marketed by Hercules Incorporated of Wilmington, Del.), temporary wet strength resins: cationic dialdehyde starch-based resin (such as Caldas produced by Japan Carlet or Cobond 1000 produced by National Starch) and dry strength binders (i.e. carboxymethyl cellulose marketed by Hercules Incorporated of Wilmington, Del., and Redibond 5320 marketed by National Starch and Chemical corporation of Bridgewater, N.J.).

The tissue paper products of the present invention preferably comprise from about 0.01% to about 3.0% of binder materials, either permanent or temporary wet strength binders, and/or from about 0.01% to about 3.0% of a dry strength binder.

Without being bound by theory, it is believed that the ester-functional quaternary ammonium compound softener compounds are effective debonding agents that act to debond the fiber-to-fiber hydrogen bonds in the tissue sheet. The combination of debonding hydrogen bonds with the polysiloxane softener, along with the introduction of chemical bonds with the wet and dry strength binders decreases the overall bond density of the tissue sheet without compromising strength and lint resistance. A reduced bond density will create a more flexible sheet overall, with improved surface softness. Important measures of these physical property changes are the FFE-Index (Carstens) and the bulk flexibility, slip-and-stick coefficient of friction, and physiological surface smoothness as described in Ampulski at al., 1991 International Paper Physics Conference Proceedings, book 1, page 19–30, incorporated herein by reference.

Briefly, the process for making the tissue paper products of the present invention comprises the steps of formation of a single-layered or multi-layered paper making furnish from the aforementioned components except for the polysiloxane compound, deposition of the paper making furnish onto a foraminous surface such as a Fourdrinier wire, and removal of the water from the deposited furnish. The polysiloxane compound is preferably added to at least one surface of the dried tissue paper web. The resulting single-layered or multi-layered tissue webs can be combined with one or more other tissue webs to form a multi-ply tissue.

All percentages, ratios and proportions herein are by weight unless otherwise specified.

BRIEF DESCRIPTION OF THE DRAWINGS

While the Specification concludes with claims particularly pointing out and distinctly claiming the present invention, it is believed the invention is better understood from the following description taken in conjunction with the associated drawings, in which:

Figure 1:
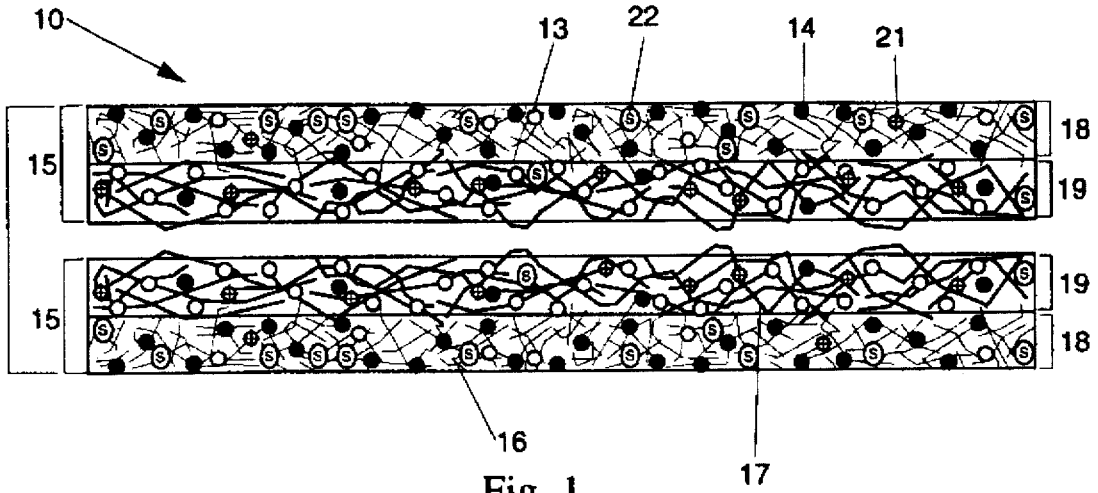
FIG. 1 is a schematic cross-sectional view of a two-ply, two-layer tissue paper in accordance with the present invention.

The present invention is described in more detail below.

DETAILED DESCRIPTION OF THE INVENTION

While this specification concludes with claims particularly pointing out and distinctly claiming the subject matter regarded as the invention, it is believed that the invention can be better understood from a reading of the following detailed description and of the appended examples.

As used herein, the term "lint resistance" is the ability of the fibrous product, and its constituent webs, to bind together under use conditions, including when wet. In other words, the higher the lint resistance is, the lower the propensity of the web to lint will be.

As used herein, the term "binder" refers to the various wet and dry strength resins and retention aid resins known in the paper making art.

As used herein, the term "water soluble" refers to materials that are soluble in water to at least 3% at 25° C.

As used herein, the terms "tissue paper web, paper web, web, paper sheet and paper product" all refer to sheets of paper made by a process comprising the steps of forming an aqueous paper making furnish, depositing this furnish on a foraminous surface, such as a Fourdrinier wire, and removing the water from the furnish as by gravity or vacuum-assisted drainage, with or without pressing, and by evaporation.

As used herein, an "aqueous paper making furnish" is an aqueous slurry of paper making fibers and the chemicals described hereinafter.

As used herein, the term "multi-layered tissue paper web, multi-layered paper web, multi-layered web, multi-layered paper sheet and multi-layered paper product" all refer to sheets of paper prepared from two or more layers of aqueous paper making furnish which are preferably comprised of different fiber types, the fibers typically being relatively long softwood and relatively short hardwood fibers as used in tissue paper making. The layers are preferably formed from the deposition of separate streams of dilute fiber slurries, upon one or more endless foraminous screens. If the individual layers are initially formed on separate wires, the layers are subsequently combined (while wet) to form a layered composite web.

As used herein the term "multi-ply tissue paper product" refers to a tissue paper consisting of at least two plies. Each individual ply in turn can consist of single-layered or multi-layered tissue paper webs. The multi-ply structures are formed by bonding together two or more tissue webs such as by glueing or embossing.

It is anticipated that wood pulp in all its varieties will normally comprise the paper making fibers used in this invention. However, other cellulose fibrous pulps, such as cotton liners, bagasse, rayon, etc., can be used and none are disclaimed. Wood pulps useful herein include chemical pulps such as Kraft, sulfite and sulfate pulps as well as mechanical pulps including for example, ground wood, thermomechanical pulps and Chemi-ThermoMechanical Pulp (CTMP). Pulps derived from both deciduous and coniferous trees can be used.

Synthetic fibers such as rayon, polyethylene and polypropylene fibers, may also be utilized in combination with the above-identified natural celluose fibers. One exemplary polyethylene fiber which may be utilized is Pulpex®, available from Hercules, Inc. (Wilmington, Del.).

Both hardwood pulps and softwood pulps as well as blends of the two may be employed. The terms hardwood pulps as used herein refers to fibrous pulp derived from the woody substance of deciduous trees (angiosperms): wherein softwood pulps are fibrous pulps derived from the woody substance of coniferous trees (gymnosperms). Hardwood pulps such as eucalyptus are particularily suitable for the outer layers of the multi-layered tissue webs described hereinafter, whereas northern softwood Kraft pulps are preferred for the inner layer(s) or ply(s). Also applicable to the present invention are low cost fibers derived from recycled paper, which may contain any or all of the above categories as well as other non-fibrous materials such as fillers and adhesives used to facilitate the original paper making.

Two Component Chemical Softener Compositions

The present invention contains as an essential component a chemical softening composition comprising an ester-functional quaternary ammonium compound and a polysiloxane compound. The ratio of the ester-functional quaternary ammonium compound to the polysiloxane compound ranges from about 3.0:0.01 to 0.01:3.0; preferably, the weight ratio of the ester-functional quaternary ammonium compound to the polysiloxane compound is about 1.0:0.3 to 0.3:1.0; more preferably, the weight ratio of the ester-functional quaternary ammonium compound to the polysiloxane compound is about 1.0:0.7 to 0.7:1.0. Each of these types of compounds will be described in detail below.

A. Ester-functional Quaternary Ammonium Compound

The ester-functional chemical softening composition contains as an essential component from about 0.01% to about 3.00% by weight, preferably from about 0.01% to about 1.00% by weight of an ester-functional quaternary ammonium compound, preferably ester-functional quaternary ammonium compounds having the formula:

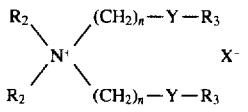

or

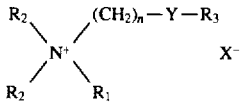

or

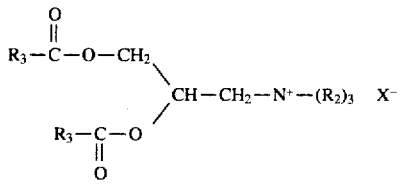

wherein each $R_1$ substituent is a $C_{12}$–$C_{22}$ hydrocarbyl group, or substituted hydrocarbyl group or mixtures thereof; each $R_2$ substituent is a $C_1$–$C_6$ alkyl or hydroxyalkyl group, benzyl group or mixtures thereof; each $R_3$ substituent is a $C_{11}$–$C_{21}$ hydrocarbyl group, or substituted hydrocarbyl or mixtures thereof; Y is —O—C(O)— or —C(O)—O— or —NH—C(O) or —C(O)—NH— or mixtures thereof; n is 1 to 4 and $X^-$ is a suitable anion, for example, chloride, bromide, methylsulfate, ethyl sulfate, nitrate and the like.

As discussed in Swern, Ed. in Bailey's Industrial Oil and Fat Products, Third Edition, John Wiley and Sons (New York 1964), tallow is a naturally occurring material having a variable composition. Table 6.13 in the above-identified reference edited by Swern indicates that typically 78% or more of the fatty acids of tallow contain 16 or 18 carbon atoms. Typically, half of the fatty acids present in tallow are unsaturated, primarily in the form of oleic acid. Synthetic as well as natural "tallows" fall within the scope of the present invention. It is also known that depending upon the product characteristic requirements, the saturation level of the ditallow can be tailored from non hydrogenated (soft) to touch, partially or completely hydrogenated (hard). All of above-described levels of saturations are expressly meant to be included within the scope of the present invention.

It will be understood that substituents $R_1$, $R_2$ and $R_3$ may optionally be substituted with various groups such as alkoxyl, hydroxyl, or can be branched, but such materials are not preferred herein. Preferably, each $R_1$ is $C_{12}$–$C_{18}$ alkyl and/or alkenyl, most preferably each $R_1$ is straight-chain $C_{16}$–$C_{18}$ alkyl and/or alkenyl. Preferably, each $R_2$ is methyl or hydroxyethyl. Preferably $R_3$ is $C_{13}$–$C_{17}$ alkyl and/or alkenyl, most preferably $R_3$ is straight chain $C_{15}$–$C_{17}$ alkyl and/or alkenyl, and $X^-$ is chloride or methyl sulfate. Furthermore the ester-functional quaternary ammonium compounds can optionally contain up to about 10% of the mono(long chain alkyl) derivatives, e.g., $(R_2)_2$—$N^+$—$((CH_2)_2OH)$ $((CH_2)_2OC(O)R_3)$ $X^-$ as minor ingredients. These minor ingredients can act as emulsifiers and are useful in the present invention.

Specific examples of ester-functional quaternary ammonium compounds having the structures named above and suitable for use in the present invention include the well-known di-ester di(alkyl) dimethyl ammonium salts such as di-ester ditallow dimethyl ammonium chloride, mono-ester ditallow dimethyl ammonium chloride, di-ester ditallow dimethyl ammonium methyl sulfate, di-ester di(hydrogenated)tallow dimethyl ammonium methyl sulfate, di-ester di(hydrogenated)tallow dimethyl ammonium chloride, and mixtures thereof. Di-ester ditallow dimethyl ammonium chloride and di-ester di(hydrogenated)tallow dimethyl ammonium chloride are particularly preferred. These particular materials are available commercially from Witco Chemical Company Inc. of Dublin, Ohio under the tradename "ADOGEN DDMC®".

Di-quat variations of the ester-functional quaternary ammonium compound can also be used, and are meant to fall within the scope of the present invention. These compounds have the formula:

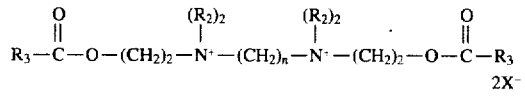

In the structure named above each $R_2$ is a $C_1$–$C_6$ alkyl or hydroxyalkyl group, $R_3$ is $C_{11}$–$C_{21}$ hydrocarbyl group, n is 2 to 4 and $X^-$ is a suitable anion, such as an halide (e.g., chloride or bromide) or methyl sulfate. Preferably, each $R_3$ is $C_{13}$–$C_{17}$ alkyl and/or alkenyl, most preferably each $R_3$ is straight-chain $C_{15}$–$C_{17}$ alkyl and/or alkenyl, and $R_2$ is a methyl.

B. Polysiloxane Compound

In general, suitable polysiloxane materials for use in the present invention include those having monomeric siloxane units of the following structure:

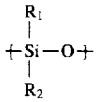

wherein, $R_1$ and $R_2$, for each independent siloxane monomeric unit can each independently be hydrogen or any alkyl, aryl, alkenyl, alkaryl, arakyl, cycloalkyl, halogenated hydrocarbon, or other radical. Any of such radicals can be substituted or unsubstituted. $R_1$ and $R_2$ radicals of any particular monomeric unit may differ from the corresponding functionalities of the next adjoining monomeric unit. Additionally, the polysiloxane can be either a straight chain, a branched chain or have a cyclic structure. The radicals $R_1$ and $R_2$ can additionally independently be other silaceous functionalities such as, but not limited to siloxanes, polysiloxanes, silanes, and polysilanes. The radicals $R_1$ and $R_2$ may contain any of a variety of organic functionalities including, for example, alcohol, carboxylic acid, aldehyde, ketone and amine, amide functionalities.

Exemplary alkyl radicals are methyl, ethyl, propyl, butyl, pentyl, hexyl, octyl, decyl, octadecyl, and the like. Exemplary alkenyl radicals are vinyl, allyl, and the like. Exemplary aryl radicals are phenyl, diphenyl, naphthyl, and the like. Exemplary alkaryl radicals are toyl, xylyl, ethylphenyl, and the like. Exemplary arakyl radicals are benzyl, alpha-phenylethyl, beta-phenylethyl, alpha-phenylbutyl, and the like. Exemplary cycloalkyl radicals are cyclobutyl, cyclopentyl, cyclohexyl, and the like. Exemplary halogenated hydrocarbon radicals are chloromethyl, bromoethyl, tetrafluorethyl, fluorethyl, trifluorethyl, trifluorotoyl, hexafluoroxylyl, and the like.

Viscosity of polysiloxanes useful may vary as widely as the viscosity of polysiloxanes in general vary, so long as the polysiloxane is flowable or can be made to be flowable for application to the tissue paper. Preferably the polysiloxane has an intrinsic viscosity ranging from about 100 to about 1000 centipoises. References disclosing polysiloxanes include U.S. Pat. No. 2,826,551, issued Mar. 11, 1958 to Geen; U.S. Pat. No. 3,964,500, issued Jun. 22, 1976 to Drakoff; U.S. Pat. No. 4,364,837, issued Dec. 21, 1982, Pader, U.S. Pat. No. 5,059,282, issued Oct. 22, 1991 to Ampulksi et al.; and British Patent No. 849,433, published Sep. 28, 1960 to Woolston. All of these patents are incorporated herein by reference. Also, incorporated herein by reference is *Silicon Compounds*, pp 181–217, distributed by Petrarch Systems, Inc., 1984, which contains an extensive listing and description of polysiloxanes in general.

The polysiloxane can be applied to the tissue paper by wet web application or by dry web application. At least one surface of the web should be contacted with the polysiloxane. The polysiloxane is preferably applied to a dry web in an aqueous solution either in neat form or emulsified with a suitable surfactant emulsifier. Emulsified silicone is most preferable for ease of application since a neat silicone aqueous solution will tend to rapidly separate into water and silicone phases, thereby impairing even distribution of the silicone on the web. The polysiloxane is preferably applied to the dry web after the web is creped.

Preferred methods of applying the polysiloxane compound to a dry tissue web are described in U.S. Pat. Nos. 5,246,546 issued to Ampulski on Sep. 21, 1993, and 5,215,626 issued to Ampulksi et al. on Jun. 1, 1993, both of which are incorporated herein by reference. In the preferred process described in the '546 patent, the polysiloxane compound is preferably sprayed onto the calendar rolls.

It is also contemplated to apply the polysiloxane to paper webs before the paper webs are dried and/or creped, though in most cases the dried web will have been creped prior to polysiloxane treatment as part of the papermaking process. It is preferred to apply the polysiloxane to dry webs using as little water as possible, since aqueous wetting of the dry sheet is believed to reduce sheet strength which can only be partially recovered upon drying. Application of polysiloxane in a solution containing a suitable solvent, such as hexane, in which the polysiloxane dissolves or is miscible in is thus contemplated.

Preferably, a sufficient amount of polysiloxane to impart a tactile sense of softness is applied to both surfaces of the tissue paper. When polysiloxane is applied to one surface of the tissue paper, some of it will at least partially penetrate to the tissue paper interior. This is especially true when the polysiloxane is applied in solution. One method found to be useful for facilitating polysiloxane penetration to the opposing surface when the polysiloxane is applied to a wet tissue paper web is to vacuum dewater the tissue paper subsequent to application. A preferred method of applying the polysiloxane compound to a wet tissue web is described in U.S. Pat. No. 5,164,046 issued to Ampulski et al. on Nov. 17, 1992, incorporated herein by reference.

Wet Strength Binder Materials

The present invention contains as an essential component from about 0.01% to about 3.0%, preferably from about 0.01% to about 1.0% by weight of wet strength, either permanent or temporary, binder materials.

A. Permanent wet strength binder materials

The permanent wet strength binder materials are chosen from the following group of chemicals: polyamide-epichlorohydrin, polyacrylamides, styrenebutadiene latexes; insolubilized polyvinyl alcohol; urea-formaldehyde; polyethyleneimine; chitosan polymers and mixtures thereof. Preferably the permanent wet strength binder materials are selected from the group consisting of polyamide-epichlorohydrin resins, polyacrylamide resins, and mixtures thereof. The permanent wet strength binder materials act to control linting and also to offset the loss in tensile strength, if any, resulting from the chemical softener compositions.

Polyamide-epichlorohydrin resins are cationic wet strength resins which have been found to be of particular utility. Suitable types of such resins are described in U.S. Pat. Nos. 3,700,623, issued on Oct. 24, 1972, and 3,772,076, issued on Nov. 13, 1973, both issued to Keim and both being hereby incorporated by reference. One commercial source of a useful polyamide-epichlorohydrin resins is Hercules, Inc. of Wilmington, Del., which markets such resin under the trade-mark Kymeme ® 557H.

Polyacrylamide resins have also been found to be of utility as wet strength resins. These resins are described in U.S. Pat. Nos. 3,556,932, issued on Jan. 19, 1971, to Coscia, et al. and 3,556,933, issued on Jan. 19, 1971, to Williams et al., both patents being incorporated herein by reference. One commercial source of polyacrylamide resins is American Cyanamid Co. of Stanford, Conn., which markets one such resin under the trade-mark Parez ® 631 NC.

Still other water-soluble cationic resins finding utility in this invention are urea formaldehyde and melamine formaldehyde resins. The more common functional groups of these polyfunctional resins are nitrogen containing groups such as amino groups and methylol groups attached to nitrogen. Polyethylenimine type resins may also find utility in the present invention.

B. Temporary wet strength binder materials

The above-mentioned wet strength additives typically result in paper products with permanent wet strength, i.e., paper which when placed in an aqueous medium retains a substantial portion of its initial wet strength over time. However, permanent wet strength in some types of paper products can be an unnecessary and undesirable property. Paper products such as toilet tissues, etc., are generally disposed of after brief periods of use into septic systems and the like. Clogging of these systems can result if the paper product permanently retains its hydrolysis-resistant strength properties. More recently, manufacturers have added temporary wet strength additives to paper products for which wet strength is sufficient for the intended use, but which then decays upon soaking in water. Decay of the wet strength facilitates flow of the paper product through septic systems.

Examples of suitable temporary wet strength resins include modified starch temporary wet strength agents, such as National Starch 78-0080, marketed by the National Starch and Chemical Corporation (New York, N.Y.). This type of wet strength agent can be made by reacting dimethoxyethyl-N-methyl-chloroacetamide with cationic starch polymers.

Modified starch temporary wet strength agents are also described in U.S. Pat. No. 4,675,394, Solarek, et al., issued Jun. 23, 1987, and incorporated herein by reference. Preferred temporary wet strength resins include those described in U.S. Pat. No. 4,981,557, Bjorkquist, issued Jan. 1, 1991, and incorporated herein by reference.

With respect to the classes and specific examples of both permanent and temporary wet strength resins listed above, it should be understood that the resins listed are exemplary in nature and are not meant to limit the scope of this invention.

Mixtures of compatible wet strength resins can also be used in the practice of this invention.

Dry strength binder materials

The present invention contains as an optional component from about 0.01% to about 3.0%, preferably from about 0.01% to about 1.0% by weight of a dry strength binder material chosen from the following group of materials: polyacrylamide (such as combinations of Cypro 514 and Accostrength 711 produced by American Cyanamid of Wayne, N.J.); starch (such as Redibond 5320 and 2005) available from National Starch and Chemical Company, Bridgewater, N.J.; polyvinyl alcohol (such as Airvol 540 produced by Air Products Inc of Allentown, Pa.); guar or locust bean gums; and/or carboxymethyl cellulose (such as CMC from Hercules, Inc. of Wilmington, Del.). Preferably, the dry strength binder materials are selected from the group consisting of carboxymethyl cellulose resins, and unmodified starch based resins and mixtures thereof. The dry strength binder materials act to control linting and also to offset the loss in tensile strength, if any, resulting from the chemical softener compositions.

In general, suitable starch for practicing the present invention is characterized by water solubility, and hydrophilicity. Exemplary starch materials include corn starch and potato starch, albeit it is not intended to thereby limit the scope of suitable starch materials; and waxy corn starch that is known industrially as amioca starch is particularly preferred. Amioca starch differs from common corn starch in that it is entirely amylopectin, whereas common corn starch contains both amplopectin and amylose. Various unique characteristics of amioca starch are further described in "Amioca—The Starch from Waxy Corn", H. H. Schopmeyer, Food Industries, December 1945, pp. 106–108 (Vol. pp. 1476–1478). The starch can be in granular or dispersed form albeit granular form is preferred. The starch is preferably sufficiently cooked to induce swelling of the granules. More preferably, the starch granules are swollen, as by cooking, to a point just prior to dispersion of the starch granule. Such highly swollen starch granules shall be referred to as being "fully cooked". The conditions for dispersion in general can vary depending upon the size of the starch granules, the degree of crystallinity of the granules, and the amount of amylose present. Fully cooked amioca starch, for example, can be prepared by heating an aqueous slurry of about 4× consistency of starch granules at about 190° F. (about 88° C.) for between about 30 and about 40 minutes. Other exemplary starch materials which may be used include modified cationic starches such as those modified to have nitrogen containing groups such as amino groups and methylol groups attached to nitrogen, available from National Starch and Chemical Company, (Bridgewater, N.J.). Such modified starch materials are used primarily as a pulp furnish additive to increase wet and/or dry strength. Considering that such modified starch materials are more expensive than unmodified starches, the latter have generally been preferred.

Methods of application include, the same previously described with reference to application of other chemical additives preferably by wet end addition, spraying; and, less preferably, by printing. The binder material may be applied to the tissue paper web alone, simultaneously with, prior to, or subsequent to the addition of the chemical softening composition. At least an effective amount of binder materials, either permanent or temporary wet strength binders, and/or dry strength binders, preferably a combination of a permanent wet strength resin such as Kymene® 557H and a dry strength resin such as CMC is applied to the sheet, to provide lint control and concomitant strength increase upon drying relative to a non-binder treated but otherwise identical sheet. Preferably, between about 0.01% and about 3.0% of binder materials are retained in the dried sheet, calculated on a dry fiber weight basis; and, more preferably, between about 0.1% and about 1.0% of binder materials is retained.

The second step in the process of this invention is the depositing of the single-layered or multi-layered paper making furnish using the above described chemical softener composition and binder materials as additives on a foraminous surface and the third step is the removing of the water from the furnish so deposited. Techniques and equipment which can be used to accomplish these two processing steps will be readily apparent to those skilled in the paper making art. Preferred multi-layered tissue paper embodiments of the present invention contain from about 0.01% to about 3.0%, more preferably from about 0.1% to 1.0% by weight, on a dry fiber basis of the chemical softening composition and binder materials described herein. The resulting single-layered or multi-layered tissue webs can be combined with one or more other tissue webs to form a multi-ply tissue.

The present invention is applicable to tissue paper in general, including but not limited to conventionally felt-pressed tissue paper; high bulk pattern densified tissue paper; and high bulk, uncompacted tissue paper. The tissue paper products made therefrom may be of a single-layered or multi-layered construction. Tissue structures formed from layered paper webs are described in U.S. Pat. No. 3,994,771, Morgan, Jr. et al. issued Nov. 30, 1976, U.S. Pat. No. 4,300,981, Carstens, issued Nov. 17, 1981, 4,166,001, Dunning et al., issued Aug.28, 1979, and European Patent Publication No. 0 613 979 A1, Edwards et al., published Sep. 7, 1994, all of which are incorporated herein by reference. In general, a wet-laid composite, soft, bulky and absorbent paper structure is prepared from two or more layers of furnish which are preferably comprised of different fiber types. The layers are preferably formed from the deposition of separate streams of dilute fiber slurries, the fibers typically being relatively long softwood and relatively short hardwood fibers as used in multi-layered tissue paper making, upon one or more endless foraminous screens. If the individual layers are initially formed on separate wires, the layers are subsequently combined (while wet) to form a layered composite web. The layered web is subsequently caused to conform to the surface of an open mesh drying/imprinting fabric by the application of a fluid force to the web and thereafter thermally predried on said fabric as part of a low density paper making process. The web may be stratified with respect to fiber type or the fiber content of the respective layers may be essentially the same. The multi-layered tissue paper preferably has a basis weight of between 10 g/m$^2$ and about 65 g/m$^2$, and density of about 0.60 g/cm$^3$ or less. Preferably, basis weight will be below about 35 g/m$^2$ or less; and density will be about 0.30 g/cm$^3$ or less. Most preferably, density will be between 0.04 g/cm$^3$ and about 0.20 g/cm$^3$.

In a preferred embodiment of this invention, tissue structures are formed from multi-layered paper webs as described in U.S. Pat. No. 4,300,981, Carstens, issued Nov. 17, 1981 and incorporated herein by reference. According to Carstens, such paper has a high degree of subjectively perceivable softness by virtue of being: multi-layered; having a top surface layer comprising at least about 60% and preferable about 85% or more of short hardwood fibers; having an HTR (Human Texture Response)-Texture of the top surface layer of about 1.0 or less, and more preferably about 0.7 or less, and most preferably about 0.1 or less; having an FFE (Free Fiber End)-Index of the top surface of about 60 or more, and preferably about 90 or more. The process for making such paper includes the step of breaking sufficient interfiber bonds between the short hardwood fibers defining its top surface to provide sufficient free end portions thereof to achieve the required FFE-Index of the top surface of the tissue paper. Such bond breaking is achieved by dry creping the tissue paper from a creping surface to which the top surface layer (short fiber layer) has been adhesive secured, and the creping should be affected at a consistency (dryness) of at least about 80% and preferably at least about 95% consistency. Such tissue paper may be made through the use of conventional felts, or foraminous carrier fabrics. Such tissue paper may be but is not necessarily of relatively high bulk density.

The individual plies contained in the tissue paper products of the present invention preferably comprise at least two superposed layers, an inner layer and an outer layer contiguous with the inner layer. The outer layers preferably comprise a primary filamentary constituent of about 60% or more by weight of relatively short paper making fibers having an average fiber between about 0.2 mm and about 1.5 mm. These short paper making fibers are typically hardwood fibers, preferably, eucalyptus fibers. Alternatively, low cost sources of short fibers such as sulfite fibers, thermomechanical pulp, Chemi-ThermoMechanical Pulp (CTMP) fibers, recycled fibers, and mixtures thereof can be used in the outer layers or blended in the inner layer, if desired. The inner layer preferably comprises a primary filamentary constituent of about 60% or more by weight of relatively long paper making fibers having an average fiber length of least about 2.0 mm. These long paper making fibers are typically softwood fibers, preferably, northern softwood Kraft fibers.

In a preferred embodiment of the present invention, facial tissue paper products are formed by placing at least two multi-layered tissue paper webs in juxtaposed relation. For example, a two-layered, two-ply tissue paper product can be made by joining a first two-layered tissue paper web and a second two-layered tissue paper web in juxtaposed relation. In this example, each ply is a two-layer tissue sheet comprising an inner layer and an outer layer. The outer layer preferably comprises the short hardwood fibers and the inner layer preferably comprises the long softwood fibers. The two plies are combined in a manner such that the short hardwood fibers in the outer layers of each ply face outwardly, and the inner layers containing the long softwood fibers face inwardly. In other words, the outer layer of each ply forms one exposed surface of the tissue and each of said inner layer of each ply are disposed toward the interior of the facial tissue web.

FIG. 1 is a schematic cross-sectional view of a two-layered two-ply facial tissue in accordance with the present invention. Referring to FIG. 1, the two-layered, two-ply web 10, is comprised of two plies 15 in juxtaposed relation. Each ply 15 is comprised of inner layer 19, and outer layer 18. Outer layers 18 are comprised primarily of short paper making fibers 16; whereas inner layers 19 are comprised primarily of long paper making fibers 17.

Figure 2:
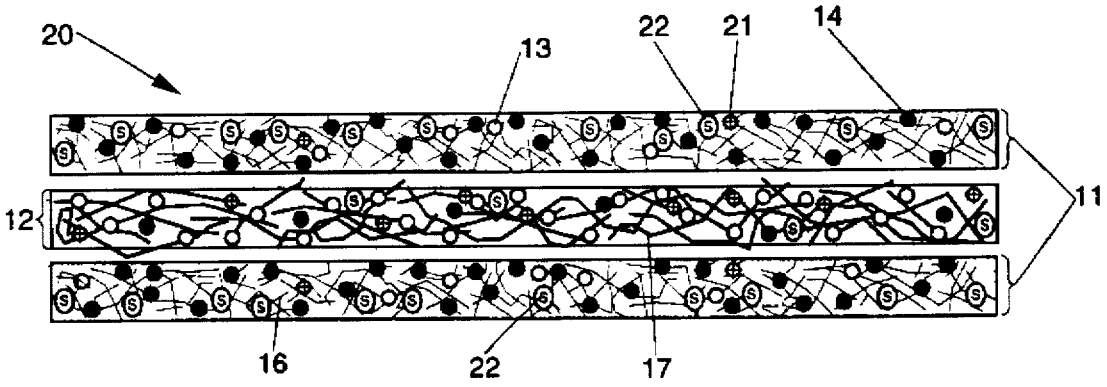
FIG. 2 is a schematic cross-sectional view of a three-ply, single-layer tissue paper in accordance with the present invention.

In an alternate embodiment of the present invention, tissue paper products are formed by placing three single-layered tissue paper webs in juxtaposed relation. In this example, each ply is a single-layered tissue sheet made of softwood or hardwood fibers. The outer plies preferably comprise the short hardwood fibers and the inner ply preferably comprises long softwood fibers. The three plies are combined in a manner such that the short hardwood fibers face outwardly. FIG. 2 is a schematic cross-sectional view of a single-layered three-ply facial tissue in accordance with the present invention. Referring to FIG. 2, the single-layered three-ply web 20, is comprised of three plies in juxtaposed relation. Two outer plies 11 are comprised primarily of short paper making fibers 16; whereas inner ply 12 is comprised primarily of long paper making fibers 17. In a variation of this embodiment (not shown) each of two outer plies can be comprised of two superposed layers.

Figure 3:
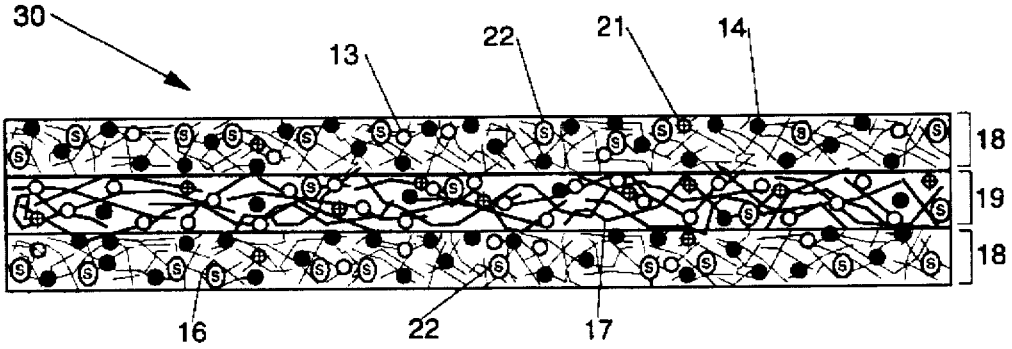
FIG. 3 is a a schematic cross-sectional view of a single-ply, three-layer tissue paper in accordance with the present invention.

In an other alternate preferred embodiment of the present invention, tissue paper products are formed by combining three layers of tissue webs into a single-ply. In this example, a single-ply tissue paper product comprises a three-layer tissue sheet made of softwood and/or hardwood fibers. The outer layers preferably comprise the short hardwood fibers and the inner layer preferably comprises long softwood fibers. The three layers are formed in a manner such that the short hardwood fibers face outwardly. FIG. 3 is a schematic cross-sectional view of a single-ply three-layer toilet tissue in accordance with the present invention. Referring to FIG. 3, the single-ply three-layer web 30, is comprised of three layers in juxtaposed relation. Two outer layers 18 are comprised primarily of short paper making fibers 16; whereas inner layer 19 is comprised primarily of long paper making fibers 17.

It should not be inferred from the above discussion that the present invention is limited to tissue paper products comprising three plies—single layer or two-ply—two layers, single-ply—three layers, etc. All tissue paper products layered or homogenous, comprising an ester-functional quaternary ammonium compound, a polysiloxane compound and binder materials are expressly meant to be included within the scope of the present invention.

Preferably, the majority of the ester-functional quaternary ammonium compound and the polysiloxane compound is contained in at least one of the outer layers (or outer plies of a three-ply single-layer product) of the tissue paper product of the present invention. More preferably, the majority of the ester-functional quaternary ammonium compound and the polysiloxane compound is contained in both of the outer layers (or outer plies of a three-ply single-layer product). It has been discovered that the chemical softening composition is most effective when added to the outer layers or plies of the tissue paper products. There, the mixture of the quaternary compound and polysiloxane compound act to enhance the softness of the multi-ply or multi-layered tissue paper products of the present invention. Referring to FIGS. 1, 2 and 3 the ester-functional quaternary ammonium compound is represented by dark circles 14 and the polysiloxane compound is represented by "S" filled circles 22. It can be seen in FIGS. 1, 2 and 3 that the majority of the ester-functional quaternary ammonium compound 14 the polysiloxane compound 22 are contained in outer layers 18 and outer plies 11, respectively.

However, it has also been discovered that the lint resistance of the multilayered tissue paper products decreases with the inclusion of the ester-functional quaternary ammonium compound and the polysiloxane compound. Therefore, binder materials are used for linting control and to increase the tensile strength. Preferably, the binder materials are contained in the inner layer (or inner ply of a three-ply product) and at least one of the outer layers (or outer plies of a three-ply single-layer product) of the tissue paper products of the present invention. More preferably, the majority of the binder materials are contained in the inner layers (or inner ply of a three-ply product) of the tissue paper product. Referring to FIGS. 1, 2 and 3 the permanent and/or temporary wet strength binder materials are schematically represented by white circles 13, the dry strength binder materials are schematically represented by cross-filled circles 21. It can be seen in FIGS. 1,2 and 3 that the majority of the binder materials 13 and 21 are contained in both of the inner layers 19 and inner ply 12, respectively.

The combination of the chemical softening composition comprising an ester-functional quaternary ammonium compound and a polysiloxane compound in conjunction with binder materials results in a tissue paper product having superior softness and lint resistant properties. Selectively adding the majority of the chemical softening composition to the outer layers or plies of the tissue paper, enhances its effectiveness. Typically the binder materials are dispersed throughout the tissue sheet to control linting. However, like the chemical softening composition, the binder materials can be selectively added where most needed.

Conventionally pressed multi-layered tissue paper and methods for making such paper are known in the art. Such paper is typically made by depositing paper making furnish on a foraminous forming wire. This forming wire is often referred to in the art as a Fourdrinier wire. Once the furnish is deposited on the forming wire, it is referred to as a web. The web is dewatered by transferring to a dewatering felt, pressing the web and drying at elevated temperature. The particular techniques and typical equipment for making webs according to the process just described are well known to those skilled in the art. In a typical process, a low consistency pulp furnish is provided in a pressurized headbox. The headbox has an opening for delivering a thin deposit of pulp furnish onto the Fourdrinier wire to form a wet web. The web is then typically dewatered to a fiber consistency of between about 7% and about 25% (total web weight basis) by vacuum dewatering and further dewatered by pressing operations wherein the web is subjected to pressure developed by opposing mechanical members, for example, cylindrical rolls.

The dewatered web is then further pressed during transfer and is dried by a stream drum apparatus known in the art as a Yankee dryer. Pressure can be developed at the Yankee dryer by mechanical means such as an opposing cylindrical drum pressing against the web. Vacuum may also be applied to the web as it is pressed against the Yankee surface. Multiple Yankee dryer drums may be employed, whereby additional pressing is optionally incurred between the drums. The multi-layered tissue paper structures which are formed are referred to hereinafter as conventional, pressed, multi-layered tissue paper structures. Such sheets are considered to be compacted since the entire web is subjected to substantial mechanical compression forces while the fibers are moist and are then dried while in a compressed state.

Pattern densified tissue paper is characterized by having a relatively high bulk field of relatively low fiber density and an array of densified zones of relatively high fiber density. The high bulk field is alternatively characterized as a field of pillow regions. The densified zones are alternatively referred to as knuckle regions. The densified zones may be discretely spaced within the high bulk field or may be interconnected, either fully or partially, within the high bulk field. Preferred processes for making pattern densified tissue webs are disclosed in U.S. Pat. No. 3,301,746, issued to Sanford and Sisson on Jan. 31, 1967, U.S. Pat. No. 3,974,025, issued to Peter G. Ayers on Aug. 10, 1976, and U.S. Pat. No. 4,191,609, issued to Paul D. Trokhan on Mar. 4, 1980, and U.S. Pat. No. 4,637,859, issued to Paul D. Trokhan on Jan. 20, 1987, U.S. Pat. No. 4,942,077 issued to Wendt et al. on Jul. 17, 1990, European Patent Publication No. 0 617 164 A1, Hyland et al., published Sep. 28, 1994, European Patent Publication No. 0 616 074 A1, Hermans et al., published Sep. 21, 1994; all of which are incorporated herein by reference.

In general, pattern densified webs are preferably prepared by depositing a paper making furnish on a foraminous forming wire such as a Fourdrinier wire to form a wet web and then juxtaposing the web against an array of supports. The web is pressed against the array of supports, thereby resulting in densified zones in the web at the locations geographically corresponding to the points of contact between the array of supports and the wet web. The remainder of the web not compressed during this operation is referred to as the high bulk field. This high bulk field can be further dedensified by application of fluid pressure, such as with a vacuum type device or a blow-through dryer. The web is dewatered, and optionally predried, in such a manner so as to substantially avoid compression of the high bulk field. This is preferably accomplished by fluid pressure, such as with a vacuum type device or blow-through dryer, or alternately by mechanically pressing the web against an array of supports wherein the high bulk field is not compressed. The operations of dewatering, optional predrying and formation of the densified zones may be integrated or partially integrated to reduce the total number of processing steps performed. Subsequent to formation of the densified zones, dewatering, and optional predrying, the web is dried to completion, preferably still avoiding mechanical pressing. Preferably, from about 8% to about 55% of the multi-layered tissue paper surface comprises densified knuckles having a relative density of at least 125% of the density of the high bulk field.

The array of supports is preferably an imprinting carrier fabric having a patterned displacement of knuckles which operate as the array of supports which facilitate the formation of the densified zones upon application of pressure. The pattern of knuckles constitutes the array of supports previously referred to. Imprinting carrier fabrics are disclosed in U.S. Pat. No. 3,301,746, Sanford and Sisson, issued Jan. 31, 1967, U.S. Pat. No. 3,821,068, Salvucci, Jr. et al., issued May 21, 1974, U.S. Pat. No. 3,974,025, Ayers, issued Aug. 10, 1976, U.S. Pat. No. 3,573,164, Friedberg et al., issued Mar. 30, 1971, U.S. Pat. No. 3,473,576, Amneus, issued Oct. 21, 1969, U.S. Pat. No. 4,239,065, Trokhan, issued Dec. 16, 1980, and U.S. Pat. No. 4,528,239, Trokhan, issued Jul. 9, 1985, all of which are incorporated herein by reference.

Preferably, the furnish is first formed into a wet web on a foraminous forming carrier, such as a Fourdrinier wire. The web is dewatered and transferred to an imprinting fabric. The furnish may alternately be initially deposited on a foraminous supporting carrier which also operates as an imprinting fabric. Once formed, the wet web is dewatered and, preferably, thermally predried to a selected fiber consistency of between about 40% and about 80%. Dewatering can be performed with suction boxes or other vacuum devices or with blow-through dryers. The knuckle imprint of the imprinting fabric is impressed in the web as discussed above, prior to drying the web to completion. One method for accomplishing this is through application of mechanical pressure. This can be done, for example, by pressing a nip roll which supports the imprinting fabric against the face of a drying drum, such as a Yankee dryer, wherein the web is disposed between the nip roll and drying drum. Also, preferably, the web is molded against the imprinting fabric prior to completion of drying by application of fluid pressure with a vacuum device such as a suction box, or with a blow-through dryer. Fluid pressure may be applied to induce impression of densified zones during initial dewatering, in a separate, subsequent process stage, or a combination thereof.

Uncompacted, nonpattern-densified multi-layered tissue paper structures are described in U.S. Pat. No. 3,812,000 issued to Joseph L. Salvucci, Jr. and Peter N. Yiannos on May 21, 1974 and U.S. Pat. No. 4,208,459, issued to Henry E. Becker, Albert L. McConnell, and Richard Schutte on Jun. 17, 1980, both of which are incorporated herein by reference. In general, uncompacted, non pattern densified multi-layered tissue paper structures are prepared by depositing a paper making furnish on a foraminous forming wire such as a Fourdrinier wire to form a wet web, draining the web and removing additional water without mechanical compression until the web has a fiber consistency of at least 80%, and creping the web. Water is removed from the web by vacuum dewatering and thermal drying. The resulting structure is a soft but weak high bulk sheet of relatively uncompacted fibers. Bonding material is preferably applied to portions of the web prior to creping.

The tissue paper product of this invention can be used in any application where soft, absorbent tissue paper products are required. Particularly advantageous uses of the tissue paper product of this invention are in toilet tissue and facial tissue products.

The first step in the process of this invention is the forming of an aqueous paper making furnish. The furnish comprises paper making fibers (hereinafter sometimes referred to as wood pulp), and a mixture of at least one ester-functional quaternary ammonium compound, and binder materials, either permanent or temporary wet strength binders, and/or optionally dry strength binders and a wetting agent, all of which will be hereinafter described. The second step in the process of this invention is spraying a solution of a polysiloxane compound and a surfactant on at least one surface of the dry tissue web after creping.

Figure 4:
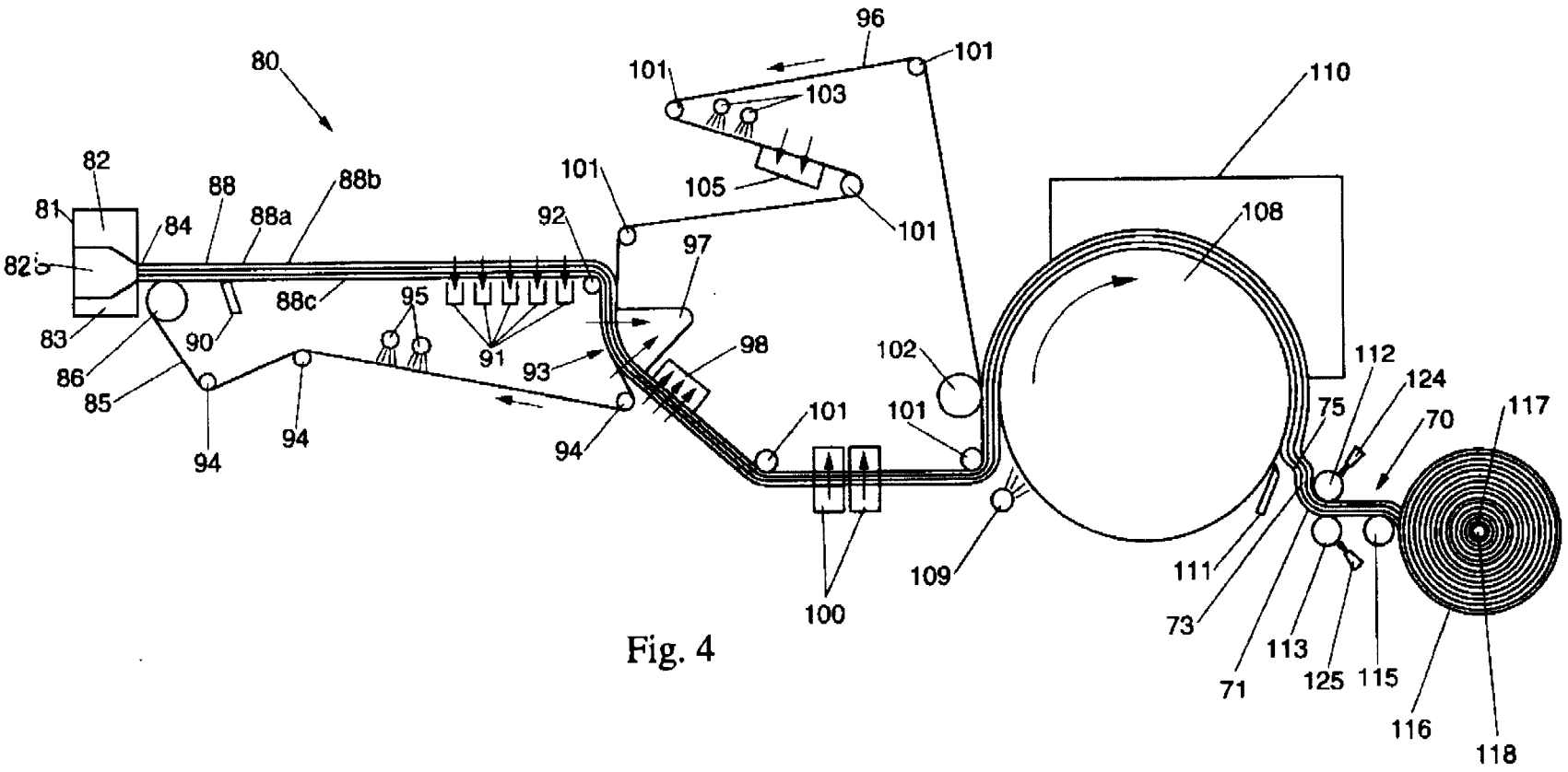
FIG. 4 is a schematic representation of a papermaking machine useful for producing a soft tissue paper in accordance with the present invention.

FIG. 4 is a schematic representation illustrating preferred embodiments of the papermaking process of the present invention for producing a soft creped tissue paper. These preferred embodiments are described in the following discussion, wherein reference is made to FIG. 4.

FIG. 4 is a side elevational view of a preferred papermaking machine 80 for manufacturing paper according to the present invention. Referring to FIG. 4, papermaking machine 80 comprises a layered headbox 81 having a top chamber 82 a center chamber **82*b*, and a bottom chamber 83, a slice roof 84, and a Fourdrinier wire 85 which is looped over and about breast roll 86, deflector 90, vacuum suction boxes 91, couch roll 92, and a plurality of turning rolls 94. In operation, one papermaking furnish is pumped through top chamber 82 a second papermaking furnish is pumped through center chamber 82*b*, while a third furnish is pumped through bottom chamber 83 and thence out of the slice roof 84 in over and under relation onto Fourdrinier wire 85 to form thereon an embryonic web 88 comprising layers 88*a*, and 88*b*, and 88*c*. Dewatering occurs through the Fourdrinier wire 85 and is assisted by deflector 90 and vacuum boxes 91. As the Fourdrinier wire makes its return run in the direction shown by the arrow, showers 95 clean it prior to its commencing another pass over breast roll 86. At web transfer zone 93, the embryonic web 88 is transferred to a foraminous carrier fabric 96 by the action of vacuum transfer box 97. Carrier fabric 96 carries the web from the transfer zone 93 past vacuum dewatering box 98, through blow-through predryers 100 and past two turning rolls 101 after which the web is transferred to a Yankee dryer 108 by the action of pressure roll 102. The carrier fabric 96 is then cleaned and dewatered as it completes its loop by passing over and around additional turning rolls 101, showers 103, and vacuum dewatering box 105. The predried paper web is adhesively secured to the cylindrical surface of Yankee dryer 108 aided by adhesive applied by spray applicator 109. Drying is completed on the steam heated Yankee dryer 108 and by hot air which is heated and circulated through drying hood 110 by means not shown. The web is then dry creped from the Yankee dryer 108 by doctor blade 111 after which it is designated paper sheet 70 comprising a Yankee-side layer 71 a center layer 73, and an off-Yankee-side layer 75. Paper sheet 70 then passes between calendar rolls 112 and 113, about a circumferential portion of reel 115, and thence is wound into a roll 116 on a core 117 disposed on shaft 118**.

The polysiloxane compound is applied to paper sheet 70. In the embodiment illustrated in FIG. 4, an aqueous mixture containing an emulsified polysiloxane compound is sprayed onto paper sheet 70 through spray applicators 124 and 125, depending on whether the polysiloxane is to be applied to both sides of the tissue web or just to one side. Although FIG. 4 shows the polysiloxane compound sprayed onto the calendar rolls, the polysiloxane compound could also be added to dry paper sheet 70 after the calendar rolls 112 and 113.

Still referring to FIG. 4, the genesis of Yankee-side layer 71 of paper sheet 70 is the furnish pumped through bottom chamber 83 of headbox 81, and which furnish is applied directly to the Fourdrinier wire 85 whereupon it becomes layer **88*c* of embryonic web 88. The genesis of the center layer 73 of paper sheet 70 is the furnish delivered through chamber 82*b* of headbox 81, and which furnish forms layer 88*b* on top of layer 88*c*. The genesis of the off-Yankee-side layer 75 of paper sheet 70 is the furnish delivered through top chamber 82 of headbox 81, and which furnish forms layer 88*a* on top of layer 88*b* of embryonic web 88. Although FIG. 4 shows papermachine 80 having headbox 81 adapted to make a three-layer web, headbox 81** may alternatively be adapted to make unlayered, two layer or other multi-layered webs.

Further, with respect to making paper sheet 70 embodying the present invention on papermaking machine 80, FIG. 4, the Fourdrinier wire 85 must be of a fine mesh having relatively small spans with respect to the average lengths of the fibers constituting the short fiber furnish so that good formation will occur; and the foraminous carrier fabric 96 should have a fine mesh having relatively small opening spans with respect to the average lengths of the fibers constituting the long fiber furnish to substantially obviate bulking the fabric side of the embryonic web into the inter-filamentary spaces of the fabric 96. Also, with respect to the process conditions for making exemplary paper sheet 70, the paper web is preferably dried to about 80% fiber consistency, and more preferably to about 95% fiber consistency prior to creping.

Analytical and Testing Procedures

Analysis of the amounts of treatment chemicals herein retained on tissue paper webs can be performed by any method accepted in the applicable art. For example, the level of the ester-functional quaternary ammonium compounds, such as di-ester di(oleyl)dimethyl ammonium chloride, di-ester di(tallow)dimethyl ammonium chloride retained by the tissue paper can be determined by solvent extraction of the ester-functional quaternary ammonium compound by an organic solvent such as dichloro methane followed by an anionic/cationic titration using Dimidium Bromide Disulphine Blue mixed indicator, product #19189 available from Gallard-Schlesinger Industries of Carle Place, N.Y. The level of polysiloxane compound can be determined by solvent extraction of the oil compound with an organic solvent followed by atomic absorption spectroscopy to determine the level of oil compound in the extract. Similarily, the level of the polyhydroxy compound retained by the tissue paper can be determined by solvent extraction of the polyhydroxy compound with a solvent. In some cases, additional procedures may be necessary to remove interfering compounds from the polyhydroxy species of interest. For instance, the Weibull solvent extraction method employs a brine solution to isolate polyethylene glycols from nonionic surfactants (Longman, G. F., *The Analysis of Detergents and Detergent Products* Wiley Interscience, New York, 1975, p. 312). The polyhydroxy species could then be analyzed by spectroscopic or chromatographic techniques. For example, compounds with at least six ethylene oxide units can typically be analyzed spectroscopically by the Ammonium cobaltothiocyanate method (Longman, G. F., *The Analysis of Detergents and Detergent Products*, Wiley Interscience, New York, 1975, p. 346). Gas chromatography techniques can also be used to separate and analyze polyhydroxy type compounds. Graphitized poly(2,6-diphenyl-p-phenylene oxide) gas chromatography columns have been used to separate polyethylene glycols with the number of ethylene oxide units ranging from 3 to 9 (Alltech chromatography catalog, number 300, p. 158).

The level of nonionic surfactants, such as alkyl glycosides, can be determined by chromatographic techniques. Bruns reported a High Performance Liquid chromatography method with light scattering detection for the analysis of alkyl glycosides (Bruns, A., Waldhoff, H., Winkle, W., *Chromatographia*, vol. 27, 1989, p. 340). A Supercritical Fluid Chromatography (SFC) technique was also described in the analysis of alkyl glycosides and related species (Lafosse, M., Rollin, P., Elfakir, c., Morin-Allory, L., Martens, M., Dreux, M., Journal of chromatography, vol. 505, 1990, p. 191). The level of anionic surfactants, such as linear alkyl sulfonates, can be determined by water extraction followed by titration of the anionic surfactant in the extract. In some cases, isolation of the linear alkyl sulfonate from interferences may be necessary before the two phase titration analysis (Cross, J., *Anionic Surfactants—Chemical Analysis*, Dekker, New York, 1977, p. 18, p. 222). The level of starch can be determined by amylase digestion of the starch to glucose followed by colorimetry analysis to determine glucose level. For this starch analysis, background analyses of the paper not containing the starch must be run to subtract out possible contributions made by interfering background species. These methods are exemplary, and are not meant to exclude other methods which may be useful for determining levels of particular components retained by the tissue paper.

A. Panel Softness

Ideally, prior to softness testing, the paper samples to be tested should be conditioned according to Tappi Method #T402OM-88. Here, samples are preconditioned for 24 hours at a relative humidity level of 10 to 35% and within a temperature range of 22° to 40° C. After this preconditioning step, samples should be conditioned for 24 hours at a relative humidity of 48 to 52% and within a temperature range of 22° to 24° C.

Ideally, the softness panel testing should take place within the confines of a constant temperature and humidity room. If this is not feasible, all samples, including the controls, should experience identical environmental exposure conditions.

Softness testing is performed as a paired comparison in a form similar to that described in "Manual on Sensory Testing Methods", ASTM Special Technical Publication 434, published by the American Society For Testing and Materials 1968 and is incorporated herein by reference. Softness is evaluated by subjective testing using what is referred to as a Paired Difference Test. The method employs a standard external to the test material itself. For tactile perceived softness two samples are presented such that the subject cannot see the samples, and the subject is required to choose one of them on the basis of tactile softness. The result of the test is reported in what is referred to as Panel Score Unit (PSU). With respect to softness testing to obtain the softness data reported herein in PSU, a number of softness panel tests are performed. In each test ten practiced softness judges are asked to rate the relative softness of three sets of paired samples. The pairs of samples are judged one pair at a time by each judge: one sample of each pair being designated X and the other Y. Briefly, each X sample is graded against its paired Y sample as follows:

1. a grade of plus one is given if X is judged to may be a little softer than Y, and a grade of minus one is given if Y is judged to may be a little softer than X;
2. a grade of plus two is given if X is judged to surely be a little softer than Y, and a grade of minus two is given if Y is judged to surely be a little softer than X;
3. a grade of plus three is given to X if it is judged to be a lot softer than Y, and a grade of minus three is given if Y is judged to be a lot softer than X; and, lastly:
4. a grade of plus four is given to X if it is judged to be a whole lot softer than Y, and a grade of minus 4 is given if Y is judged to be a whole lot softer than X.

The grades are averaged and the resultant value is in units of PSU. The resulting data are considered the results of one panel test. If more than one sample pair is evaluated then all sample pairs are rank ordered according to their grades by paired statistical analysis. Then, the rank is shifted up or down in value as required to give a zero PSU value to which ever sample is chosen to be the zero-base standard. The other samples then have plus or minus values as determined by their relative grades with respect to the zero base standard. The number of panel tests performed and averaged is such that about 0.2 PSU represents a significant difference in subjectively perceived softness.

B. Hydrophilicity (absorbency)

Hydrophilicity of tissue paper refers, in general, to the propensity of the tissue paper to be wetted with water. Hydrophilicity of tissue paper may be somewhat quantified by determining the period of time required for dry tissue paper to become completely wetted with water. This period of time is referred to as "wetting time". In order to provide a consistent and repeatable test for wetting time, the following procedure may be used for wetting time determinations: first, a conditioned sample unit sheet (the environmental conditions for testing of paper samples are 22° to 24° C. and 48 to 52% R. H. as specified in TAPPI Method T 402), approximately 4⅜ inch×4¾ inch (about 11.1 cm×12 cm) of tissue paper structure is provided; second, the sheet is folded into four (4) juxtaposed quarters, and then crumpled by hand (either covered with clean plastic gloves or copiously washed with a grease removing detergent such as Dawn) into a ball approximately 0.75 inches (about 1.9 cm) to about 1 inch (about 2.5 cm) in diameter; third, the balled sheet is placed on the surface of a body of 3 liters of distilled water at 22° to 24° C. contained in a 3 liter pyrex glass beaker. It should also be noted all testing of the paper through this technique should take place within the confines of the controlled temperature and humidity room at 22° to 24° C. and 48 to 52% relative humidity. The sample ball is then carefully placed on the surface of the water from a distance no greater than 1 cm above the water surface. At the exact moment the ball touches the water surface, a timer is simultaneously started; fourth, the second ball is placed in the water after the first ball is completely wetted out. This is easily noted by the paper color transitioning from its dry white color to a darker grayish coloration upon complete wetting. The timer is stopped and the time recorded after the fifth ball has completely wet out.

At least 5 sets of 5 balls (for a total of 25 balls) should be run for each sample. The final reported result should be the calculated average and standard deviation taken for the 5 sets of data. The units of the measurement are seconds. The water must be changed after the 5 sets of 5 balls (total=25 balls) have been tested. copious cleaning of the beaker may be necessary if a film or residue is noted on the inside wall of the beaker.

Another technique to measure the water absorption rate is through pad sink measurements. After conditioning the tissue paper of interest and all controls for a minimum of 24 hours at 22° to 24° C. and 48 to 52% relative humidity (Tappi method #T402OM-88), a stack of 5 to 20 sheets of tissue paper is cut to dimensions of 2.5" to 3.0". The cutting can take place through the use of dye cutting presses, a conventional paper cutter, or laser cutting techniques. Manual scissors cutting is not preferred due to both the irreproducibility in handling of the samples, and the potential for paper contamination.

After the paper sample stack has been cut, it is carefully placed on a wire mesh sample holder. The function of this holder is to position the sample on the surface of the water with minimal disruption. This holder is circular in shape and has a diameter of approximately 4.2". It has five straight and evenly spaced metal wires running parallel to one another and across to spot welded points on the wire's circumference. The spacing between the wires is approximately 0.7". This wire mesh screen should be clean and dry prior to placing the paper on its surface. A 3 liter beaker is filled with about 3 liters of distilled water stabilized at a temperature of 22° to 24° C. After insuring oneself that the water surface is free of any waves or surface motion, the screen containing the paper is carefully placed on top of the water surface. The screen sample holder is allowed to continue downward after the sample floats on the surface so the sample holder screen handle catches on the side of the beaker. In this way, the screen does not interfere with the water absorption of the paper sample. At the exact moment the paper sample touches the surface of the water, a timer is started. The timer is stopped after the paper stack is completely wetted out. This is easily visually observed by noting a transition in the paper color from its dry white color to a darker grayish coloration upon complete wetting. At the instant of complete wetting, the timer is stopped and the total time recorded. This total time is the time required for the paper pad to completely wet out.

This procedure is repeated for at least 2 additional tissue paper pads. No more than 5 pads of paper should be run without disposing of the water and post cleaning and refilling of the beaker with fresh water at a temperature of 22° to 24° C. Also, if new and unique sample is to be run, the water should always be changed to the fresh starting state. The final reported time value for a given sample should be the average and standard deviations for the 3 to 5 stacks measured. The units of the measurement are seconds.

Hydrophilicity characteristics of tissue paper embodiments of the present invention may, of course, be determined immediately after manufacture. However, substantial increases in hydrophobicity may occur during the first two weeks after the tissue paper is made: i.e., after the paper has aged two (2) weeks following its manufacture. Thus, the wetting times are preferably measured at the end of such two week period. Accordingly, wetting times measured at the end of a two week aging period at room temperature are referred to as "two week wetting times." Also, optional aging conditions of the paper samples may be required to try and mimic both long term storage conditions and/or possible severe temperature and humidity exposures of the paper products of interest. For instance, exposure of the paper sample of interest to temperatures in the range of 49° to 82° C. for 1 hour to 1 year can mimic some of potentially severe exposures conditions a paper sample may experience in the trade. Also, autoclaving of the paper samples can mimic severe aging conditions the paper may experience in the trade. It must be reiterated that after any severe temperature testing, the samples must be reconditioned at a temperature of 22° to 24° C. and a relative humidity of 48 to 52%. All testing should also be done within the confines of the controlled temperature and humidity room.

C. Density

The density of tissue paper, as that term is used herein, is the average density calculated as the basis weight of that paper divided by the caliper, with the appropriate unit conversions incorporated therein to convert to g/cc. Caliper of the tissue paper, as used herein, is the thickness of the paper when subjected to a compressive load of 95 g/in$^2$ (15.5 g/cm$^2$). The caliper is measured with a Thwing-Albert model 89-II thickness tester (Thwing-Albert Co. of Philadelphia, Pa.). The basis weight of the paper is typically determined on a 4"×4" pad which is 8 plies thick. This pad is preconditioned according to Tappi Method #T402OM-88 and then the weight is measured in units of grams to the nearest ten-thousanths of a gram. Appropriate conversions are made to report the basis weight in units of pounds per 3000 square feet.

D. Lint

Dry lint

Dry lint can be measured using a Sutherland Rub Tester, a piece of black felt (made of wool having a thickness of about 2.4 mm and a density of about 0.2 gm/cc. Such felt material is readily available form retail fabric stores such as Hancock Fabric), a four pound weight and a Hunter Color meter. The Sutherland tester is a motor-driven instrument which can stroke a weighted sample back and forth across a stationary sample. The piece of black felt is attached to the four pound weight. The tissue sample is mounted on a piece of cardboard (Crescent #300 obtained from Cordage of Cincinnati, Ohio) The tester then rubs or moves the weighted felt over a stationary tissue sample for five strokes. The load applied to the tissue during rubbing is about 33.1 gm/sq.cm. The Hunter Color L value of the black felt is determined before and after rubbing. The difference in the two Hunter Color readings constitutes a measurement of dry linting. Other methods known in the prior arts for measuring dry lint also can be used.

Wet lint

A suitable procedure for measuring the wet linting property of tissue samples is described in U.S. Pat. No. 4,950,545; issued to Walter et al., on Aug. 21, 1990, and incorporated herein by reference. The procedure essentially involves passing a tissue sample through two steel rolls, one of which is partially submerged in a water bath. Lint from the tissue sample is transferred to the steel roll which is moistened by the water bath. The continued rotation of the steel roll deposits the lint into the water bath. The lint is recovered and then counted. See col. 5, line 45 - col. 6, line 27 of the Walter et al. patent. Other methods known in the prior art for measuring wet lint also can be used.

Optional Ingredients

Other chemicals commonly used in papermaking can be added to the chemical softening composition described herein, or to the papermaking furnish so long as they do not significantly and adversely affect the softening, absorbency of the fibrous material, and softness enhancing actions of the ester-functional quaternary ammonium compound and polysiloxane softening compounds of the present invention.

Wetting Agents:

The present invention may contain as an optional ingredient from about 0.005% to about 3.0%, more preferably from about 0.03% to 1.0% by weight, on a dry fiber basis of a wetting agent.

Polyhydroxy Compound

The chemical softening composition contains as an optional component from about 0.01% to about 3.00% by weight, preferably from about 0.01% to about 1.00% by weight of a water soluble polyhydroxy compound.

Examples of polyhydroxy compounds useful in the present invention include glycerol, polyglycerols having a weight average molecular weight of from about 150 to about 800 and Polyethylene Glycols and polyoxypropylene glycols having a weight average molecular weight of from about 200 to about 4000, preferably from about 200 to about 1000, most preferably from about 200 to about 600. Polyethylene Glycols having an weight average molecular weight of from about 200 to about 600 are especially preferred. Mixtures of the above-described polyhydroxy compounds may also be used. For example, mixtures of glycerol and Polyethylene Glycols having a weight average molecular weight from about 200 to 1000, more preferably from about 200 to 600 are useful in the present invention. Preferably, the weight ratio of glycerol to Polyethylene Glycol ranges from about 10:1 to 1:10.

A particularly preferred polyhydroxy compound is Polyethylene Glycol having an weight average molecular weight of about 400. This material is available commercially from the Union Carbide Company of Danbury, Conn. under the tradename "PEG-400".

Nonionic Surfactant (Alkoxylated Materials)

Suitable nonionic surfactants that can be used as wetting agents in the present invention include addition products of ethylene oxide and, optionally, propylene oxide, with fatty alcohols, fatty acids, fatty amines, etc.

Any of the alkoxylated materials of the particular type described hereinafter can be used as the nonionic surfactant. Suitable compounds are substantially water-soluble surfactants of the general formula:

$$R_2—Y—(C_2H_4O)_z—C_2H_4OH$$

wherein $R_2$ for both solid and liquid compositions is selected from the group consisting of primary, secondary and branched chain alkyl and/or acyl hydrocarbyl groups; primary, secondary and branched chain alkenyl hydrocarbyl groups; and primary, secondary and branched chain alkyl- and alkenyl-substituted phenolic hydrocarbyl groups; said hydrocarbyl groups having a hydrocarbyl chain length of from about 8 to about 20, preferably from about 10 to about 18 carbon atoms. More preferably the hydrocarbyl chain length for liquid compositions is from about 16 to about 18 carbon atoms and for solid compositions from about 10 to about 14 carbon atoms. In the general formula for the ethoxylated nonionic surfactants herein, Y is typically —O—, —C(O)O—, —C(O)N(R)—, or —C(O)N(R)R—, in which $R_2$, and R, when present, have the meanings given herein before, and/or R can be hydrogen, and z is at least about 8, preferably at least about 10–11. Performance and, usually, stability of the softener composition decrease when fewer ethoxylate groups are present.

The nonionic surfactants herein are characterized by an HLB (hydrophiliclipophilic balance) of from about 7 to about 20, preferably from about 8 to about 15. Of course, by defining $R_2$ and the number of ethoxylate groups, the HLB of the surfactant is, in general, determined. However, it is to be noted that the nonionic ethoxylated surfactants useful herein, for concentrated liquid compositions, contain relatively long chain $R_2$ groups and are relatively highly ethoxylated. While shorter alkyl chain surfactants having short ethoxylated groups may possess the requisite HLB, they are not as effective herein.

Examples of nonionic surfactants follow. The nonionic surfactants of this invention are not limited to these examples. In the examples, the integer defines the number of ethoxyl (EO) groups in the molecule.

Linear Alkoxylated Alcohols a. Linear, Primary Alcohol Alkoxylates

The deca-, undeca-, dodeca-, tetradeca-, and pentadeca-ethoxylates of n-hexadecanol, and n-octadecanol having an HLB within the range recited herein are useful wetting agents in the context of this invention. Exemplary ethoxylated primary alcohols useful herein as the viscosity/dispersibility modifiers of the compositions are n-$C_{18}$EO(10); and n-$C_{10}$EO(11). The ethoxylates of mixed natural or synthetic alcohols in the "oleyl" chain length range are also useful herein. Specific examples of such materials include oleylalcohol-EO(11), oleylalcohol-EO(18), and oleylalcohol -EO(25).

b. Linear, Secondary Alcohol Alkoxylates

The deca-, undeca-, dodeca-, tetradeca-, pentadeca-, octadeca-, and nonadeca-ethoxylates of 3-hexadecanol, 2-octadecanol, 4-eicosanol, and 5-eicosanol having and HLB within the range recited herein can be used as wetting agents in the present invention. Exemplary ethoxylated secondary alcohols can be used as wetting agents in the present invention are: 2-$C_{16}$EO(11); 2-$C_{20}$EO(11); and 2-$C_{16}$EO(14).

Linear Alkyl Phenoxylated Alcohols

As in the case of the alcohol alkoxylates, the hexa- through octadecaethoxylates of alkylated phenols, particularly monohydric alkylphenols, having an HLB within the range recited herein are useful as the viscosity/dispersibility modifiers of the instant compositions. The hexa- through octadeca-ethoxylates of p-tridecylphenol, m-pentadecylphenol, and the like, are useful herein. Exemplary ethoxylated alkylphenols useful as the wetting agents of the mixtures herein are: p-tridecylphenol EO(11) and p-pentadecylphenol EO(18).

As used herein and as generally recognized in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

Olefinic Alkoxylates

The alkenyl alcohols, both primary and secondary, and alkenyl phenols corresponding to those disclosed immediately herein above can be ethoxylated to an HLB within the range recited herein can be used as wetting agents in the present invention

Branched Chain Alkoxylates

Branched chain primary and secondary alcohols which are available from the well-known "OXO" process can be ethoxylated and can be used as wetting agents in the present invention.

The above ethoxylated nonionic surfactants are useful in the present compositions alone or in combination, and the term "nonionic surfactant" encompasses mixed nonionic surface active agents.

The level of surfactant, if used, is preferably from about 0.01% to about 2.0% by weight, based on the dry fiber weight of the tissue paper. The surfactants preferably have alkyl chains with eight or more carbon atoms. Exemplary anionic surfactants are linear alkyl sulfonates, and alkylbenzene sulfonates. Exemplary nonionic surfactants are alkylglycosides including alkylglycoside esters such as Crodesta SL-40 which is available from Croda, Inc. (New York, N.Y.); alkylglycoside ethers as described in U.S. Pat. No. 4,011,389, issued to W. K. Langdon, et al. on Mar. 8, 1977; and alkylpolyethoxylated esters such as Pegosperse 200 ML available from Glyco Chemicals, Inc. (Greenwich, Conn.) and IGEPAL RC-520 available from Rhone Poulenc Corporation (Cranbury, N.J.).

The above listings of optional chemical additives is intended to be merely exemplary in nature, and are not meant to limit the scope of the invention.

The following examples illustrate the practice of the present invention but are not intended to be limiting thereof.

EXAMPLE 1

The purpose of this example is to illustrate a method using conventional drying and layered paper making techniques to make soft, absorbent and lint resistant multi-ply facial tissue paper treated with two chemical softener compositions, a permanent wet strength resin and a dry strength resin. One chemical softening system (hereafter refered to as the first chemical softener) comprises Di-ester Di(Touch Hardened-)Tallow DiMethyl Ammonium Chloride (DEDTHTDMAC) and a Polyethylene Glycol 400 (PEG-400); the other (hereafter refered to as the second chemical softener) is comprised of an amino-functional, polydimethylsiloxane and a suitable wetting agent to offset the hydrophobic character of the siloxane.

A plant scale S-wrap, twin wire forming paper making machine is used in the practice of the present invention. The first chemical softener composition is a homogenous premix of DEDTHTDMAC and PEG-400 in solid state which is melted at a temperature of about 88° C. (190° F.). The melted mixture is then dispersed in a conditioned water tank (Temperature ~66° C.) to form a sub-micron vesicle dispersion. The particle size of the vesicle dispersion is determined using an optical microscopic technique. The particle size range is from about 0.1 to 1.0 micron. The second chemical softener is prepared by first mixing an aqueous emulsion of aminopolydimethyl siloxane (i.e. CM2266 marketed by GE Silicones of Waterford, N.Y.) with water and then blending in a wetting agent (i.e. Acconon, marketed by Karlshamns U.S.A., Inc. of Columbus, Ohio) at a weight ratio of 2 siloxane per 1 wetting agent.

Second, a 3% by weight aqueous slurry of NSK is made up in a conventional re-pulper. The NSK slurry is refined gently and a 1% solution of the permanent wet strength resin (i.e., Kymene® 557LX marketed by Hercules Incorporated of Wilmington, Del.) is added to the NSK stock pipe at a rate of 0.25% by weight of the total sheet dry fibers. The adsorption of the permanent wet strength resin onto NSK fibers is enhanced by an in-line mixer. A 2% solution of the dry strength resin (i.e. CMC from Hercules Incorporated of Wilmington, Del.) is added to the NSK stock before the fan pump at a rate of 0.083% by weight of the total sheet dry fibers. The NSK slurry is diluted to about 0.2% consistency at the fan pump.

Third, a 3% by weight aqueous slurry of Eucalyptus fibers is made up in a conventional re-pulper. A 2% solution of the first chemical softener mixture is added to the Eucalyptus stock pipe before the in-line mixer at a rate of 0.15% by weight of the total sheet dry fibers. The Eucalyptus slurry is diluted to about 0.2% consistency at the fan pump.

The individually treated furnish streams (stream 1=100% NSK/stream 2=100% Eucalyptus) are kept separate through the headbox and deposited onto a wire to form a two layer embryonic web containing equal portions of NSK and Eucalyptus. Dewatering occurs through the wire. The forming wire is a Lindsay, Series 2164 (marketed by Lindsay Wire Inc. of Florence, Miss.) or similar design. The embryonic wet web is transferred from the wire, at a fiber consistency of about 8% at the point of transfer, to a conventional felt. Further de-watering is accomplished by pressing and vacuum assisted drainage until the web has a fiber consistency of at least 35%. The web is then adhered to the surface of a Yankee dryer with the Eucalyptus fiber layer contacting the Yankee dryer. The fiber consistency is increased to an estimated 96% before dry creping the web with a doctor blade. The doctor blade has a bevel angle of about 16 degrees and is positioned with respect to the Yankee dryer to provide an impact angle of about 85 degrees; the Yankee dryer is operated at about 1100 mpm (meters per minute)—about 3607 feet per minute. The dry web is passed through a rubber-on-steel calender nip. An 18% dispersion of the second chemical softener composition is spayed uniformly on the lower, steel roll of the calender system, from which it transfers to the Eucalyptus layer of the paper web at the rate of 0.15% by weight of total sheet dry fiber with a minimum amount of moisture. The dry web is formed into roll at a speed of about 880 mpm (2860 feet per minute).

The web is converted into a two-layer, two-ply facial tissue paper as described in FIG. 1. The multi-ply facial tissue paper has about 18#/3M Sq. Ft basis weight, contains about 0.25% of the permanent wet strength resin, about 0.083% of the dry strength resin, about 0.15% of the first chemical softener mixture and about 0.15% of the second chemical softener mixture. Importantly, the resulting multi-ply tissue paper is soft, absorbent, has good lint resistance and is suitable for use as facial tissues.

EXAMPLE 2

The purpose of this example is to illustrate a method using conventional drying and layered paper making techniques to make soft, absorbent and lint resistant multi-ply facial tissue paper treated with two chemical softener compositions, a permanent wet strength resin and a dry strength resin. One chemical softening system (hereafter refered to as the first chemical softener) comprises Di-ester Di(Touch Hardened-)Tallow DiMethyl Ammonium Methyl Sulfate (DEDTHT-DMAC) and a Polyethylene Glycol 400 (PEG-400); the other (hereafter refered to as the second chemical softener) is comprised of an amino-functional, polydimethylsiloxane and a suitable wetting agent to offset the hydrophobic character of the siloxane.

A pilot scale Fourdrinier paper making machine is used in the practice of the present invention. The first chemical softener composition is a homogenous premix of DEDTH-TDMAC and PEG-400 in solid state which is melted at a temperature of about 88° C. (190° F.). The melted mixture is then dispersed in a conditioned water tank (Temperature ~66° C.) to form a sub-micron vesicle dispersion. The particle size of the vesicle dispersion is determined using an optical microscopic technique. The particle size range is from about 0.1 to 1.0 micron. The second chemical softener is prepared by first mixing an aqueous emulsion of amino-polydimethyl siloxane (i.e. CM2266 marketed by GE Silicones of Waterford, N.Y.) with water and then blending in a wetting agent (i.e. Neodol 25-12, marketed by Shell Chemical Co. of Houston, Tex.) at a weight ratio of 2 parts siloxane per 1 part wetting agent.

Second, a 3% by weight aqueous slurry of NSK is made up in a conventional re-pulper. The NSK slurry is refined gently and a 1% solution of the permanent wet strength resin (i.e. Kymene® 557H marketed by Hercules Incorporated of Wilmington, Del.) is added to the NSK stock pipe at a rate of 0.2% by weight of the total sheet dry fibers. The adsorption of the permanent wet strength resin onto NSK fibers is enhanced by an in-line mixer. A 0.25% solution of the dry strength resin (i.e. CMC from Hercules Incorporated of Wilmington, Del.) is added to the NSK stock before the fan pump at a rate of 0.05% by weight of the total sheet dry fibers. The NSK slurry is diluted to about 0.2% consistency at the fan pump.

Third, a 3% by weight aqueous slurry of Eucalyptus fibers is made up in a conventional re-pulper. A 1% solution of the permanent wet strength resin (i.e. Kymene® 557H) is added to the Eucalyptus stock pipe at a rate of 0.05% by weight of the total sheet dry fibers, followed by addition of a 0.25% solution of CMC at a rate of 0.025% by weight of the total sheet dry fibers. A 2% solution of the first chemical softener mixture is added to the Eucalyptus stock pipe before the fan pump at a rate of 0.15% by weight of the total sheet dry fibers; The Eucalyptus slurry is diluted to about 0.2% consistency at the fan pump.

The individually treated furnish streams (stream 1=100% NSK/stream 2=100% Eucalyptus) are kept separate through the headbox and deposited onto a Fourdrinier wire to form a two layer embryonic web containing equal portions of NSK and Eucalyptus. Dewatering occurs through the Fourdrinier wire and is assisted by a deflector and vacuum boxes. The Fourdrinier wire is of a 5-shed, satin weave configuration having 105 machine-direction and 107 cross-machine-direction monofilaments per inch, respectively. The embryonic wet web is transferred from the Fourdrinier wire, at a fiber consistency of about 8% at the point of transfer, to a conventional felt. Further de-watering is accomplished by pressing and vacuum assisted drainage until the web has a fiber consistency of at least 35%. The web is then adhered to the surface of a Yankee dryer with the Eucalyptus fiber layer contacting the Yankee dryer. The fiber consistency is increased to an estimated 96% before dry creping the web with a doctor blade. The doctor blade has a bevel angle of about 25 degrees and is positioned with respect to the Yankee dryer to provide an impact angle of about 81 degrees; the Yankee dryer is operated at about 800 fpm (feet per minute)—about 244 meters per minute. The dry web is passed through a rubber-on-steel calender nip. A 15% dispersion of the second chemical softener composition is spayed uniformly on the lower, steel roll of the calender system, from which it transfers to the Eucalyptus layer of the paper web at the rate of 0.15% by weight of total sheet dry fiber with a minimum amount of moisture. The dry web is formed into rolls at a speed of 650 fpm (about 198 meters per minute).

The web is converted into a two-layer, two-ply facial tissue paper as described in FIG. 1. The multi-ply facial tissue paper has about 18#/3M Sq. Ft basis weight, contains about 0.25% of the permanent wet strength resin, about 0.075% of the dry strength resin, about 0.15% of the first chemical softener mixture and about 0.15% of the second chemical softener mixture. Importantly, the resulting multi-ply tissue paper is soft, absorbent, has good lint resistance and is suitable for use as facial tissues.

EXAMPLE 3

The purpose of this example is to illustrate a method using blow through drying and layered paper making techniques to make soft, absorbent and lint resistant multi-ply facial tissue paper treated with two chemical softener compositions, a permanent wet strength resin and a dry strength resin. One chemical softening system (hereafter refered to as the first chemical softener) comprises Di-ester Di(Touch Hardened-)Tallow DiMethyl Ammonium Chloride (DEDTHTDMAC) and a Polyethylene Glycol 400 (PEG-400); the other (hereafter refered to as the second chemical softener) is comprised of an amino-functional, polydimethylsiloxane and a suitable wetting agent to offset the hydrophobic character of the siloxane.

A pilot scale Fourdrinier paper making machine is used in the practice of the present invention. The first chemical softener composition is a homogenous premix of DTHTD-MAC and PEG-400 in a solid state which is melted at a temperature of about 88° C. (190° F.). The melted mixture is then dispersed in a conditioned water tank (Temperature ~66° C.) to form a sub-micron vesicle dispersion. The particle size of the vesicle dispersion is determined using an optical microscopic technique. The particle size range is from about 0.1 to 1.0 micron. The second chemical softener is prepared by first mixing an aqueous emulsion of amino-polydimethyl siloxane (i.e. CM2266 marketed by GE Silicones of Waterford, N.Y.) with water and then blending in a wetting agent (i.e. Neodol 25-12, marketed by Shell Chemical Co. of Houston, Tex.) at a weight ratio of 2 parts siloxane per 1 part wetting agent.

Second, a 3% by weight aqueous slurry of northern softwood Kraft fibers is made up in a conventional re-pulper. The NSK slurry is refined gently and a 2% solution of the permanent wet strength resin (i.e. Kymene® 557H marketed by Hercules Incorporated of Wilmington, Del.) is added to the NSK stock pipe at a rate of 0.75% by weight of the total sheet dry fibers. The adsorption of the permanent wet strength resin onto NSK fibers is enhanced by an in-line mixer. A 1% solution of the dry strength resin (i.e., CMC from Hercules Incorporated of Wilmington, Del.) is added to the NSK stock before the fan pump at a rate of 0.2% by weight of the total sheet dry fibers. The NSK slurry is diluted to about 0.2% consistency at the fan pump.

Third, a 3% by weight aqueous slurry of Eucalyptus fibers is made up in a conventional re-pulper. A 2% solution of the permanent wet strength resin (i.e. Kymene® 557H) is added to the Eucalyptus stock pipe at a rate of 0.2% by weight of the total sheet dry fibers, followed by addition of a 1% solution of CMC at a rate of 0.05% by weight of the total sheet dry fibers. A 2% solution of the first chemical softener mixture is added to the Eucalyptus stock pipe before the fan pump at a rate of 0.2% by weight of the total sheet dry fibers. The Eucalyptus slurry is diluted to about 0.2% consistency at the fan pump.

The individually treated furnish streams (stream 1=100% NSK/stream 2=100% Eucalyptus) are kept separate through the headbox and deposited onto a Fourdrinier wire to form a two layer embryonic web containing equal portions of NSK and Eucalyptus. Dewatering occurs through the Fourdrinier wire and is assisted by a deflector and vacuum boxes. The Fourdrinier wire is of a 5-shed, satin weave configuration having 105 machine-direction and 107 cross-machine-direction monofilaments per inch, respectively. The embryonic wet web is transferred from the Fourdrinier wire, at a fiber consistency of about 15% at the point of transfer, to a photo-polymer belt made in accordance with U.S. Pat. No. 4,528,239, Trokhan, issued on 9 Jul. 1985. Further dewatering is accomplished by vacuum assisted drainage until the web has a fiber consistency of about 28%. The patterned web is pre-dried by air blow-through to a fiber consistency of about 65% by weight. The web is then adhered to the surface of a Yankee dryer with a sprayed creping adhesive comprising 0.25% aqueous solution of Polyvinyl Alcohol (PVA). The fiber consistency is increased to an estimated 96% before dry creping the web with a doctor blade. The doctor blade has a bevel angle of about 25 degrees and is positioned with respect to the Yankee dryer to provide an impact angle of about 81 degrees; the Yankee dryer is operated at about 800 fpm (feet per minute) (about 244 meters per minute). The dry web is passed through a rubber-on-steel calender nip. A 15% solution of the second chemical softener composition is spayed uniformly on the lower, steel roll of the calender system, from which it transfers to the Eucalyptus layer of the paper web at the rate of 0.15% by weight of total sheet dry fiber with a minimum amount of moisture. The dry web is formed into roll at a speed of 680 fpm (about 208 meters per minute).

The web is converted into a two-layer, two-ply facial tissue paper as described in FIG. 1. The multi-ply facial tissue paper has about 20#/3M Sq. Ft. basis weight, contains about 0.95% of the permanent wet strength resin, about 0.125% of the dry strength resin and about 0.25% of the chemical softener mixture. Importantly, the resulting multi-ply tissue paper is soft, absorbent, has good lint resistance and is suitable for use as facial tissues.

EXAMPLE 4

The purpose of this example is to illustrate a method using conventional drying paper making techniques to make soft, absorbent and lint resistant multi-ply facial tissue paper treated with two chemical softener compositions, a permanent wet strength resin and a dry strength resin. One chemical softening system (hereafter refered to as the first chemical softener) comprises Di-ester Di(Touch Hardened-)Tallow DiMethyl Ammonium Methyl Sulfate (DEDTHT-DMAC) and a Polyethylene Glycol 400 (PEG-400); the other (hereafter refered to as the second chemical softener) is comprised of an amino-functional, polydimethylsiloxane and a suitable wetting agent to offset the hydrophobic character of the siloxane.

A pilot scale Fourdrinier paper making machine is used in the practice of the present invention. The first chemical softener composition is a homogenous premix of DTHTD-MAC and PEG-400 in solid state which is melted at a temperature of about 88° C. (190° F). The melted mixture is then dispersed in a conditioned water tank (Temperature ~66° C.) to form a sub-micron vesicle dispersion. The particle size of the vesicle dispersion is determined using an optical microscopic technique. The particle size range is from about 0.1 to 1.0 micron. The second chemical softener is prepared by first mixing an aqueous emulsion of amino-polydimethyl siloxane (i.e. CM2266 marketed by GE Silicones of Waterford, N.Y.) with water and then blending in a wetting agent (i.e. Neodol 25-12, marketed by Shell Chemical Co. of Houston, Tex.) at a weight ratio of 2 parts siloxane per 1 part wetting agent.

First, a 3% by weight aqueous slurry of NSK is made up in a conventional re-pulper. A 1% solution of the permanent wet strength resin (i.e. Kymene® 557H marketed by Hercules Incorporated of Wilmington, Del.) is added to the furnish stock pipe at a rate of 0.25% by weight of the total sheet dry fibers. A 0.25% solution of the dry strength resin (i.e. CMC from Hercules Incorporated of Wilmington, Del.) is added to the furnish stock before the fan pump at a rate of 0.05% by weight of the total sheet dry fibers. The furnish slurry is diluted to about 0.2% consistency at the fan pump. The treated furnish stream is deposited onto a Fourdrinier wire to form a single layer embryonic web. Dewatering occurs through the Fourdrinier wire and is assisted by a deflector and vacuum boxes. The Fourdrinier wire is of a 5-shed, satin weave configuration having 105 machine-direction and 107 cross-machine-direction monofilaments per inch, respectively. The embryonic wet web is transferred from the Fourdrinier wire, at a fiber consistency of about 8% at the point of transfer, to a conventional felt. Further de-watering is accomplished by pressing and vacuum assisted drainage until the web has a fiber consistency of at least 35%. The web is then adhered to the surface of a Yankee dryer, and the fiber consistency is increased to an estimated 96% before dry creping the web with a doctor blade. The doctor blade has a bevel angle of about 25 degrees and is positioned with respect to the Yankee dryer to provide an impact angle of about 81 degrees; the Yankee dryer is operated at about 800 fpm (feet per minute)—about 244 meters per minute.

Second, a 3% by weight aqueous slurry of Eucalyptus is made up in a conventional re-pulper. A 1% solution of the permanent wet strength resin (i.e. Kymene® 557H marketed by Hercules Incorporated of Wilmington, Del.) is added to the furnish stock pipe at a rate of 0.25% by weight of the total sheet dry fibers. A 0.25% solution of the dry strength resin (i.e. CMC from Hercules Incorporated of Wilmington, Del.) is added to the furnish stock before the fan pump at a rate of 0.05% by weight of the total sheet dry fibers. A 2% solution of the first chemical softener mixture is added to the furnish stock pipe before the fan pump at a rate of 0.15% by weight of the total sheet dry fibers. The furnish slurry is diluted to about 0.2% consistency at the fan pump. The treated furnish stream is deposited onto a Fourdrinier wire to form a single layer embryonic web. Dewatering occurs through the Fourdrinier wire and is assisted by a deflector and vacuum boxes. The Fourdrinier wire is of a 5-shed, satin weave configuration having 105 machine-direction and 107 cross-machine-direction monofilaments per inch, respectively. The embryonic wet web is transferred from the Fourdrinier wire, at a fiber consistency of about 8% at the point of transfer, to a conventional felt. Further de-watering is accomplished by pressing and vacuum assisted drainage until the web has a fiber consistency of at least 35%. The web is then adhered to the surface of a Yankee dryer, and the fiber consistency is increased to an estimated 96% before dry creping the web with a doctor blade. The doctor blade has a bevel angle of about 25 degrees and is positioned with respect to the Yankee dryer to provide an impact angle of about 81 degrees; the Yankee dryer is operated at about 800 fpm (feet per minute)—about 244 meters per minute. The dry web is passed through a rubber-on-steel on-steel calender nip. A 15% solution of the second chemical softener composition is spayed uniformly on the lower, steel roll of the calender system, from which it transfers to the paper web at the rate of 0.15% by weight of total sheet dry fiber with a minimum amount of moisture. The dry web is formed into rolls at a speed of 650 fpm (200 meters per minute).

The webs are converted into a three-ply facial tissue paper as described in FIG. 2. The soft Eucalyptus plies are on the outside and the strong NSK ply is on the inside. The multi-ply facial tissue paper has about 26#/3M Sq. Ft basis weight, contains about 0.25% of the permanent wet strength resin, about 0.033% of the dry strength resin, about 0.10% of the first chemical softener mixture and about 0.10% of the second chemical softener mixture. Importantly, the resulting multi-ply tissue paper is soft, absorbent, has good lint resistance and is suitable for use as facial tissues.

EXAMPLE 5

The purpose of this example is to illustrate a method using blow through drying and layered paper making techniques to make soft, absorbent and lint resistant single-ply toilet tissue paper treated with two chemical softener compositions, a temporary wet strength resin and a dry strength resin. One chemical softening system (hereafter refered to as the first chemical softener) comprises Di-ester Di(Touch Hardened-)Tallow DiMethyl Ammonium Chloride (DEDTHTDMAC) and a Polyethylene Glycol 400 (PEG-400); the other (hereafter refered to as the second chemical softener) is comprised of an amino-functional, polydimethylsiloxane and a suitable wetting agent to offset the hydrophobic character of the siloxane.

A pilot scale Fourdrinier paper making machine is used in the practice of the present invention. The first chemical softener composition is a homogenous premix of DTHTDMAC and PEG-400 in a solid state which is melted at a temperature of about 88° C. (190° F.). The melted mixture is then dispersed in a conditioned water tank (Temperature ~66° C.) to form a sub-micron vesicle dispersion. The particle size of the vesicle dispersion is determined using an optical microscopic technique. The particle size range is from about 0.1 to 1.0 micron. The second chemical softener is prepared by first mixing an aqueous emulsion of amino-polydimethyl siloxane (i.e. CM2266 marketed by GE Silicones of Waterford, N.Y.) with water and then blending in a wetting agent (i.e. Neodol 25-12, marketed by Shell Chemical Co. of Houston, Tex.) at a weight ratio of 2 siloxane per 1 wetting agent.

Second, a 3% by weight aqueous slurry of northern softwood Kraft fibers is made up in a conventional re-pulper. The NSK slurry is refined gently and a 2% solution of the temporary wet strength resin (i.e. National Starch 78-0080, marketed by the National Starch and Chemical Corporation of New York, N.Y.) is added to the NSK stock pipe at a rate of 0.4% by weight of the total sheet dry fibers. The adsorption of the temporary wet strength resin onto NSK fibers is enhanced by an in-line mixer. The NSK slurry is diluted to about 0.2% consistency at the fan pump.

Third, a 3% by weight aqueous slurry of Eucalyptus fibers is made up in a conventional re-pulper. A 2% solution of the first chemical softener mixture is added to the Eucalyptus stock pipe before the in-line mixer at a rate of 0.3% by weight of the total sheet dry fibers, followed by addition of a 1% solution of CMC at a rate of 0.25% by weight of the total sheet dry fibers. The Eucalyptus slurry is divided into two equal streams and diluted to about 0.2% consistency at the fan pump.

The individually treated furnish streams (stream 1=100% NSK/stream 2 & 3=100% Eucalyptus) are kept separate through the headbox and deposited onto a Fourdrinier wire to form a three layer embryonic web containing about 30% NSK and 70% Eucalyptus. The web is formed as described in FIG. 3 with the Eucalyptus on the outside and the NSK on the inside. Dewatering occurs through the Fourdrinier wire and is assisted by a deflector and vacuum boxes. The Fourdrinier wire is a 5-shed, 84M design. The embryonic wet web is transferred from the Fourdrinier wire, at a fiber consistency of about 15% at the point of transfer, to a 44×33 5A drying/imprinting fabric. Further de-watering is accomplished by vacuum assisted drainage until the web has a fiber consistency of about 28%. The patterned web is pre-dried by air blow-through to a fiber consistency of about 65% by weight. The web is then adhered to the surface of a Yankee dryer with a sprayed creping adhesive comprising 0.25% aqueous solution of Polyvinyl Alcohol (PVA). The fiber consistency is increased to an estimated 96% before dry creping the web with a doctor blade. The doctor blade has a bevel angle of about 25 degrees and is positioned with respect to the Yankee dryer to provide an impact angle of about 81 degrees; the Yankee dryer is operated at about 800 fpm (feet per minute) (about 244 meters per minute). The dry web is passed through a rubber-on-steel calender nip. A 15% solution of the second chemical softener composition is spayed uniformly on both rolls of the calender system, from which it transfers to the Eucalyptus layers of the paper web at the rate of 0.15% by weight of total sheet dry fiber with a minimum amount of moisture. The dry web is formed into roll at a speed of 680 fpm (about 208 meters per minute).

The web is converted into a three-layer, single-ply toilet tissue paper. The single-ply toilet tissue paper has about 18#/3M Sq. Ft. basis weight, contains about 0.4% of the temporary wet strength resin, about 0.25% of the dry strength resin, about 0.3% of the first chemical softener mixture and about 0.15% of the second chemical softener mixture. Importantly, the resulting single-ply tissue paper is soft, absorbent, has good lint resistance and is suitable for use as toilet tissue.

What is claimed is:

1. A tissue paper product comprising:

a) paper making fibers;

b) from about 0.01% to about 3.0% of an ester-functional quaternary ammonium compound having the formula:

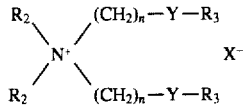

or

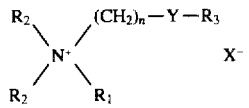

wherein each $R_2$ substituent is a $C_1$–$C_6$ alkyl or hydroxyalkyl group, benzyl group or mixtures thereof; each $R_1$ substituent is a $C_{12}$–$C_{22}$ hydrocarbyl group, or substituted hydrocarbyl group or mixtures thereof; each $R_3$ substituent is a $C_{11}$–$C_{21}$ hydrocarbyl group, or substituted hydrocarbyl or mixtures thereof; Y is —0—C(O)— or —C(O)—O— or —NH—C(O)— or —C(O)—NH— or mixtures thereof; n is 1 to 4 and $X_-$ is a suitable anion;

c) from about 0.01% to about 3.0% of a polysiloxane compound wherein said polysiloxane is polydimethylsiloxane having a hydrogen bonding functional group selected from the groups consisting of amino, carboxyl, hydroxyl, ether, polyether, aldehyde, ketone, amide, ester, and thiol groups, said hydrogen bonding functional group being present in a molar percentage of substitution of about 20% or less; and d) from about 0.01% to about 3.0% of binder materials, either wet strength binders and/or dry strength binders.

2. The tissue paper product of claim 1 comprising at least two plies, wherein each of said plies comprises at least two superposed layers, an inner layer and an outer layer contiguous with said inner layer.

3. The multi-layered tissue paper product of claim 2 wherein said tissue paper product comprises two plies in juxtaposed relation, said plies being oriented in said tissue so that said outer layer of each ply forms one exposed surface of said multi-layered tissue and each of said inner layers of said plies are disposed toward the interior of said tissue paper product.

4. The multi-layered tissue paper product of claim 3 wherein the majority of the ester-functional quaternary ammonium compound and the majority of the polysiloxane compound is contained in at least one of said outer layers.

5. The multi-layered tissue paper product of claim 4 wherein the majority of the binders is contained in at least one of said inner layers.

6. The multi-layered tissue paper product of claim 4 wherein the majority of the ester-functional quaternary ammonium compound and the polysiloxane compound is contained in both of said outer layers.

7. The multi-layered tissue paper product of claim 3 comprising both a wet strength and a dry strength binder.

8. The multi-layered tissue paper product of claim 4 wherein the majority of said binders is contained in said inner layers.

9. The multi-layered tissue paper product of claim 3 wherein each of two said inner layers comprise relatively long paper making fibers having an average length of at least about 2.0 mm and wherein each of two said outer layers comprises relatively short paper making fibers having an average length between about 0.2 mm and about 1.5 mm.

10. The multi-layered tissue paper product of claim 9 wherein said inner layers comprise softwood fibers and said outer layers comprise hardwood fibers.

11. The multi-layered tissue paper product of claim 10 wherein said softwood fibers are northern softwood Kraft fibers and wherein said hardwood fibers are eucalyptus fibers.

12. The multi-layered tissue paper product of claim 9 wherein said inner layers comprise softwood fibers or mixtures of softwood fibers and low cost fibers, and at least one of said outer layers comprises low cost fibers or mixtures of hardwood fibers and low cost fibers.

13. The multi-layered tissue paper product of claim 12 wherein said low cost fibers are selected from the group consisting of sulfite fibers, thermomechanical pulp fibers, chemi-thermomechanical pulp fibers, recycled fibers, and mixtures thereof.

14. The multi-layered tissue paper product of claim 3 wherein said wet strength binders are permanent wet strength binders selected from the group consisting of polyamide-epichlorohydrin resins, polyacrylamide resins, and mixtures thereof.

15. The multi-layered tissue paper product of claim 14 wherein said permanent wet strength binders are polyamide-epichlorohydrin resins.

16. The multi-layered tissue paper product of claim 3 wherein said wet strength binders are temporary wet strength binders selected from the group consisting of cationic dialdehyde starch-based resins, dialdehyde starch resins and mixtures thereof.

17. The multi-layered tissue paper product of claim 16 wherein said temporary wet strength binders are cationic dialdehyde starch-based resins.

18. The multi-layered tissue paper product of claim 7 wherein said dry strength binder is selected from the group consisting of carboxymethyl cellulose resins, starch based resins, polyacrylamide resins, polyvinyl alcohol resins and mixtures thereof.

19. The multi-layered tissue paper product of claim 18 wherein said dry strength binders are carboxymethyl cellulose resins.

20. The tissue paper product of claim 1 wherein $R_2$ is methyl, $R_3$ is $C_{15}$–$C_{17}$ alkyl or alkenyl and $R_1$ is $C_{16}$–$C_{18}$ alkyl or alkenyl.

21. The tissue paper product of claim 1 wherein Y is —O—C(O)— or —C(O)—O—.

22. The tissue paper product of claim 1 wherein $X^-$ is chloride or methyl sulfate.

23. A multi-layered facial tissue paper product comprising:

a) paper making fibers;

b) from about 0.01% to about 3.0% of an ester-functional quaternary ammonium compound having the formula

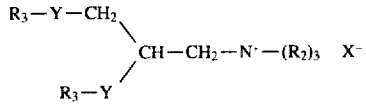

wherein each $R_2$ is a $C_1$–$C_4$ alkyl or hydroxyalkyl group, benzyl group, or mixtures thereof; each $R_3$ is a $C_{11}$–$C_{21}$ hydrocarbyl or substituted hydrocarbyl group or mixtures thereof; Y is —O—C (O)— or —C(O)—O— or —NH—C(O) or —C(O)—NH— or mixtures thereof and $X^-$ is a suitable anion;

c) from about 0.01% to about 3.0% of a polysiloxane compound, wherein said polysiloxane is polydimethylsiloxane having a hydrogen bonding functional group selected from the groups consisting of amino, carboxyl, hydroxyl, ether, polyether, aldehyde, ketone, amide, ester, and thiol groups, said hydrogen bonding functional group being present in a molar percentage of substitution of about 20% or less; and d) from about 0.01% to about 3.0% of binder materials, either wet strength binders and/or dry strength binders.

24. The multi-layered facial tissue paper product of claim 23 wherein each $R_2$ is methyl, $R_3$ is $C_{15}$–$C_{17}$ alkyl or alkenyl.

25. The multi-layered facial tissue paper product of claim 23 wherein Y is —O—C(O)— or —C(O)—O—.

26. The multi-layered facial tissue paper product of claim 23 wherein $X^-$ is chloride or methyl sulfate.

27. The multi-layered tissue paper product of claim 1 wherein the $R_3$ substituent is derived from vegetable oil sources.

28. The multi-layered tissue paper product of claim 1 wherein said polysiloxane has a molar percentage of substitution of about 10% or less, and a viscosity of about 25 centistokes or more.

29. The multi-layered tissue paper product of claim 28 wherein said polysiloxane has a molar percentage of substitution of from about 1.0% to about 5%, and a viscosity of from about 25 centistokes to about 20,000,000 centistokes.

30. The multi-layered tissue paper product of claim 29 wherein said molar percentage of substitution is about 2%, and said viscosity is about 125 centistokes.

31. The multi-layered tissue paper product of claim 30 wherein said hydrogen bonding functional group is an amino functional group.

32. The multi-layered tissue paper product of claim 7 wherein said ester-functional quaternary ammonium compound is di-ester di(touch hardened)tallow dimethyl ammonium chloride or methylsulfate, said polysiloxane compound is an amino functional polysiloxane compound, said permanent wet strength binder is polyamide-epichlorohydrin resin and said dry strength binder is carboxymethyl cellulose resin, wherein the majority of said ester-functional quaternary ammonium compound, said polysiloxane compound and said dry strength binders are contained in both of said outer layers, and wherein the majority of said wet strength binder materials is contained in both of said inner layers.

33. The tissue paper product of claim 1 wherein said tissue paper product comprises three superposed layers, two outer layers and one inner layer, said inner layer being located between two said outer layers.

34. The multi-layered tissue paper product of claim 33 wherein said outer layers further comprise a dry strength binder.

35. The multi-layered tissue paper product of claim 34 wherein said inner layer comprises long softwood fibers and said outer layers comprise short hardwood fibers.

36. The multi-layered tissue paper product of claim 35 wherein the majority of said ester-functional quaternary ammonium compound, said polysiloxane compound and said dry strength binders is contained in two said outer layers, and the majority of said temporary wet strength binders is located in said inner layer.

37. The multi-layered tissue paper product of claim 36 wherein said ester-functional quaternary ammonium compound is di-ester di(touch hardened)tallow dimethyl ammonium chloride or methylsulfate, said polysiloxane compound is amino functional polysiloxane compound, said temporary wet strength binder is cationic starch resin and said dry strength binder is carboxymethyl cellulose resin.

* * * * *